US011583463B2

(12) United States Patent
Yu et al.

(10) Patent No.: US 11,583,463 B2
(45) Date of Patent: Feb. 21, 2023

(54) HEMIPLEGIC FOREARM FUNCTION RECOVERY TRAINING DEVICE AND METHOD

(71) Applicants: Kagoshima University, Kagoshima (JP); Marumae Co., Ltd., Izumi (JP)

(72) Inventors: Yong Yu, Kagoshima (JP); Takashi Morimoto, Izumi (JP); Toshikazu Maeda, Izumi (JP); Koei Igarashi, Izumi (JP)

(73) Assignees: Kagoshima University, Kagoshima (JP); Marumae Co., Ltd., Kagoshima (JP)

( * ) Notice: Subject to any disclaimer, the term of this patent is extended or adjusted under 35 U.S.C. 154(b) by 510 days.

(21) Appl. No.: 16/642,818

(22) PCT Filed: Aug. 31, 2018

(86) PCT No.: PCT/JP2018/032373

§ 371 (c)(1),
(2) Date: Feb. 27, 2020

(87) PCT Pub. No.: WO2019/045051

PCT Pub. Date: Mar. 7, 2019

(65) Prior Publication Data

US 2021/0154080 A1 May 27, 2021

(30) Foreign Application Priority Data

Aug. 31, 2017 (JP) ..... JP2017-167540

(51) Int. Cl.
*A61H 1/02* (2006.01)

(52) U.S. Cl.
CPC ... *A61H 1/0274* (2013.01); *A61H 2201/1638* (2013.01); *A61H 2201/50* (2013.01)

(58) Field of Classification Search
CPC ..... A61H 1/0274; A61H 2201/1638; A61H 2201/50; A61H 1/0277; A61H 2201/1215;
(Continued)

(56) References Cited

U.S. PATENT DOCUMENTS 3,269,399 A * 8/1966 Smith ..... A61H 3/02 401/6
4,641,832 A * 2/1987 Mattox ..... A63B 21/00065 482/45

(Continued)

FOREIGN PATENT DOCUMENTS

CN 103110499 A 5/2013
CN 106361539 A 2/2017

(Continued)

OTHER PUBLICATIONS

International Search Report and Written Opinion dated Sep. 25, 2018, for International Patent Application Serial No. PCT/JP2018/032373 filed on Aug. 31, 2017 (Original in Japanese, and English translation enclosed).

(Continued)

*Primary Examiner* — Garrett K Atkinson
(74) *Attorney, Agent, or Firm* — K&L Gates LLP; Louis C. Cullman; Giorgios N. Kefallinos

(57) ABSTRACT

A hemiplegic forearm function recovery training device includes a forearm mounting part (2) on which a forearm (S) is to be mounted. The forearm mounting part (2) includes a mounting body (20), an inner frame portion (2B), an outer frame portion (2A), and a control part. The mounting body (20) has a forearm fixing portion (22) on which the forearm (S) is mounted and a gripping mechanism (23) capable of being gripped by a hand of the forearm (S). The inner frame portion (2B) is fitted to the mounting body (20) and is rotatable around the forearm (S). The outer frame portion (2A) guides the inner frame portion (2B) in a rotation (Continued)

direction thereof. The control part performs a series of controls that repeatedly causes normal rotation, stop, reverse rotation, and stop of the inner frame portion (2B) while acquiring rotation angle information of the inner frame portion (2B). In the normal rotation the control part controls angular velocity or acceleration of the inner frame portion (2B) to stimulate a training target muscle of the forearm (S) and in the reverse rotation the control part provides resistance to the inner frame portion (2B) to sustain stimulation to the training target muscle to maintain muscle tone.

9 Claims, 27 Drawing Sheets

(58) Field of Classification Search
CPC ..... A61H 1/0285; A61H 2201/0138; A61H 2201/5069; A61H 1/00
See application file for complete search history.

(56) References Cited

U.S. PATENT DOCUMENTS 5,738,636 A * 4/1998 Saringer ..... A61H 1/0266 601/29
5,951,499 A * 9/1999 Saringer ..... A61H 1/0274 601/5
6,506,172 B1 * 1/2003 Hepburn ..... A61H 1/0274 601/5
6,921,352 B1 * 7/2005 Stearns ..... A63B 23/14 482/44
6,988,295 B2 * 1/2006 Tillim ..... A61B 17/2909 16/110.1
7,537,547 B1 * 5/2009 Hosick ..... A63B 21/4017 482/45
7,618,381 B2 * 11/2009 Krebs ..... A61H 1/0274 601/5
7,951,096 B2 * 5/2011 Ju ..... A61H 1/0274 601/5
8,083,694 B2 * 12/2011 Peles ..... A61H 1/0277 601/5
9,233,046 B2 * 1/2016 Matjacic ..... A61H 1/0274
10,123,929 B2 * 11/2018 Celik ..... A61H 1/0274
10,682,544 B2 * 6/2020 Kudlak ..... A63B 23/03516
10,894,181 B2 * 1/2021 Ocampo ..... A63B 21/4033
2003/0074766 A1 * 4/2003 Tillim ..... B25G 1/102 16/430
2008/0077057 A1 * 3/2008 Peles ..... A61H 1/0277 601/5
2008/0097255 A1 * 4/2008 Ju ..... A61H 1/0274 601/23
2009/0030353 A1 * 1/2009 Bonutti ..... A61H 1/0274 601/5
2009/0149783 A1 * 6/2009 Nef ..... A63B 21/4049 601/5
2009/0298657 A1 * 12/2009 Potok ..... A63B 23/1245 482/141
2010/0190617 A1 * 7/2010 Gautier ..... A63B 21/4047 482/94
2010/0267523 A1 * 10/2010 Wilkinson ..... A63B 21/0726 482/45
2010/0298100 A1 * 11/2010 McVan ..... A63B 21/015 482/45
2016/0346594 A1 * 12/2016 Homewood ..... A63B 21/075
2017/0120104 A1 * 5/2017 Douglass ..... A63B 23/14
2017/0132947 A1 * 5/2017 Maeda ..... G05G 9/047
2019/0009131 A1 * 1/2019 Ocampo ..... A63B 21/4025
2019/0046832 A1 * 2/2019 Kudlak ..... A63B 23/03516
2019/0365554 A1 * 12/2019 Davies-Sekle ..... A61F 5/013
2021/0402247 A1 * 12/2021 Oetomo ..... A61H 1/0274

FOREIGN PATENT DOCUMENTS

CN 106456434 A 2/2017
JP 2008-067852 A 3/2008
JP 2010-188018 A 9/2010
JP 2011-217992 A 11/2011
JP 2012035022 A 2/2012
JP 2012-061101 A 3/2012
JP 2013-017718 A 1/2013
JP 2016-101497 A 6/2016
KR 10-1305341 B1 9/2013
TW M311417 U 5/2007
WO 2014/092076 A1 6/2014
WO 2015/190605 A1 12/2015
WO 2019/045051 A1 3/2019

OTHER PUBLICATIONS

Office Action dated Oct. 11, 2021, for corresponding Chinese Patent Application Serial No. 201880055536X.

* cited by examiner

HEMIPLEGIC FOREARM FUNCTION RECOVERY TRAINING DEVICE AND METHOD

CROSS REFERENCE TO RELATED APPLICATIONS

This application is a national phase filing of PCT/JP2018/032373, filed on Aug. 31, 2018, which claims priority to Japanese Patent Application No. 2017-167540, filed on Aug. 31, 2017, the entire disclosures each of which are incorporated herein by reference.

TECHNICAL FIELD

The present disclosure relates to a hemiplegic forearm function recovery training device and method.

BACKGROUND ART

Occurrence of stroke may result in paralysis on either the left or right side of a body. The paralysis occurring on either the left or right side is called hemiplegia. A function lost due to the hemiplegia can be partially recovered by rehabilitation. This rehabilitation is performed manually by a skilled physician or therapist. However, training takes time over a long period of time, which imposes a great physical burden on the physician or therapist. To avoid the burden, various training devices are proposed (see, for example, Patent Literatures 1 to 3).

CITATION LIST

Patent Literature

Patent Literature 1: Unexamined Japanese Patent Application Kokai Publication No. 2012-061101

Patent Literature 2: International Publication No. WO2014/092076

Patent Literature 3: Unexamined Japanese Patent Application Kokai Publication No. 2016-101497

SUMMARY OF INVENTION

Technical Problem

In the training devices described in the aforementioned Patent Literatures 1 to 3, a forearm is to be mounted on the device. However, the shapes or conditions of the forearms depend on patients, and in some cases, forearm muscular atrophy may make straight stretching of the wrist difficult. Thus mounting of the forearm on the device is hard work and takes time, and thus there are growing concerns about a decrease in training efficiency.

In view of the above circumstances, an objective of the present disclosure is to provide hemiplegic forearm function recovery training device and method capable of achieving efficient training.

Solution to Problem

To achieve the above objective, a hemiplegic forearm function recovery training device according to a first aspect of the present disclosure is a hemiplegic forearm function recovery training device for promoting recovery for a hemiplegic patient by training a paralyzed forearm of the patient. The device includes a forearm mounting part on which the forearm is to be mounted. The forearm mounting part includes a mounting body including a forearm fixing portion for fixing the forearm and a gripping mechanism capable of being gripped by a hand of the forearm fixed by the forearm fixing portion, an inner frame portion capable of being fitted to the mounting body and rotatable around the forearm, an outer frame portion to guide the inner frame portion in a rotation direction thereof, and a control part to perform a series of controls that repeatedly causes normal rotation, stop, reverse rotation, and stop of the inner frame portion while acquiring rotation angle information of the inner frame portion. In the normal rotation, the control part controls angular velocity or acceleration of the inner frame portion to stimulate a training target muscle of the forearm. In the reverse rotation, the control part provides resistance to the inner frame portion to sustain stimulation to the training target muscle to maintain muscle tone.

In this case, the gripping mechanism may include a grip that is a rod-like member extending in one direction to be capable of being gripped by the hand of the forearm, and a cross section of the grip that is orthogonal to a longitudinal direction of the grip has an elliptic or oval shape. The gripping mechanism may further include one of the following mechanisms: a first adjustment mechanism to adjust a rotation position of the grip around an axis of rotation extending in the longitudinal direction, a second adjustment mechanism to adjust offset of the grip with respect to the central axis that is a center of rotation of the inner frame portion, and a third adjustment mechanism to adjust a position of the grip relating to a direction of the central axis that is the center of rotation of the inner frame portion.

The forearm fixing portion may include a base portion to be fitted to the inner frame portion, a pair of pad portions to hold the forearm therebetween from opposite sides, and ratchet mechanisms attached to the base portion to enable the corresponding pad portions to be pushed against the forearm and enable the pushing against the forearm to be released with a one-touch manipulation.

The ratchet mechanisms may each include a slider slidable with respect to the base portion and provided with the pad portion at a tip of the slider, and the slider may be graduated.

The inner frame portion or the forearm mounting part may be provided with an elbow mount for placement of an elbow of the forearm.

The device may further include an arm part provided at a distal end with a first joint for coupling to the forearm fixing portion and at a proximal end with a second joint for coupling to a mount attached to a base. The first joint and the second joint may allow the position of the forearm fixing portion to be adjusted in 5 degrees of freedom.

The mount may include a vice mechanism attachable to a plate-like member.

A hemiplegic forearm function recovery training method according to a second aspect of the present disclosure is a hemiplegic forearm function recovery training method for promoting recovery for a hemiplegic patient by training a paralyzed forearm of the patient. The method includes mounting the forearm on a mounting body including a forearm fixing portion for fixing the forearm and a gripping mechanism capable of being gripped by a hand of the forearm fixed by the forearm fixing portion, inserting the mounting body into an inner frame portion rotatable around the forearm; and performing a series of controls that repeatedly causes normal rotation, stop, reverse rotation, and stop of the inner frame portion while acquiring rotation angle information of the inner frame portion. In the normal rotation, angular velocity or acceleration of the inner frame portion is controlled to stimulate a training target muscle of the forearm. In the reverse rotation, resistance is provided to the inner frame portion to sustain stimulation to the training target muscle to maintain muscle tone.

Advantageous Effects of Invention

According to the present disclosure, the forearm mounting part to which the forearm is mounted has separate components that are the rotary inner frame portion and the mounting body to which the forearm is mounted, and thereby only insertion of the mounting body in the inner frame portion after mounting of the forearm to the mounting body enables the forearm to be easily mounted in the device. As a result, training can be effectively performed.

DESCRIPTION OF EMBODIMENTS

Embodiments of the present disclosure are described in detail hereinafter with reference to the drawings.

Figure 1:
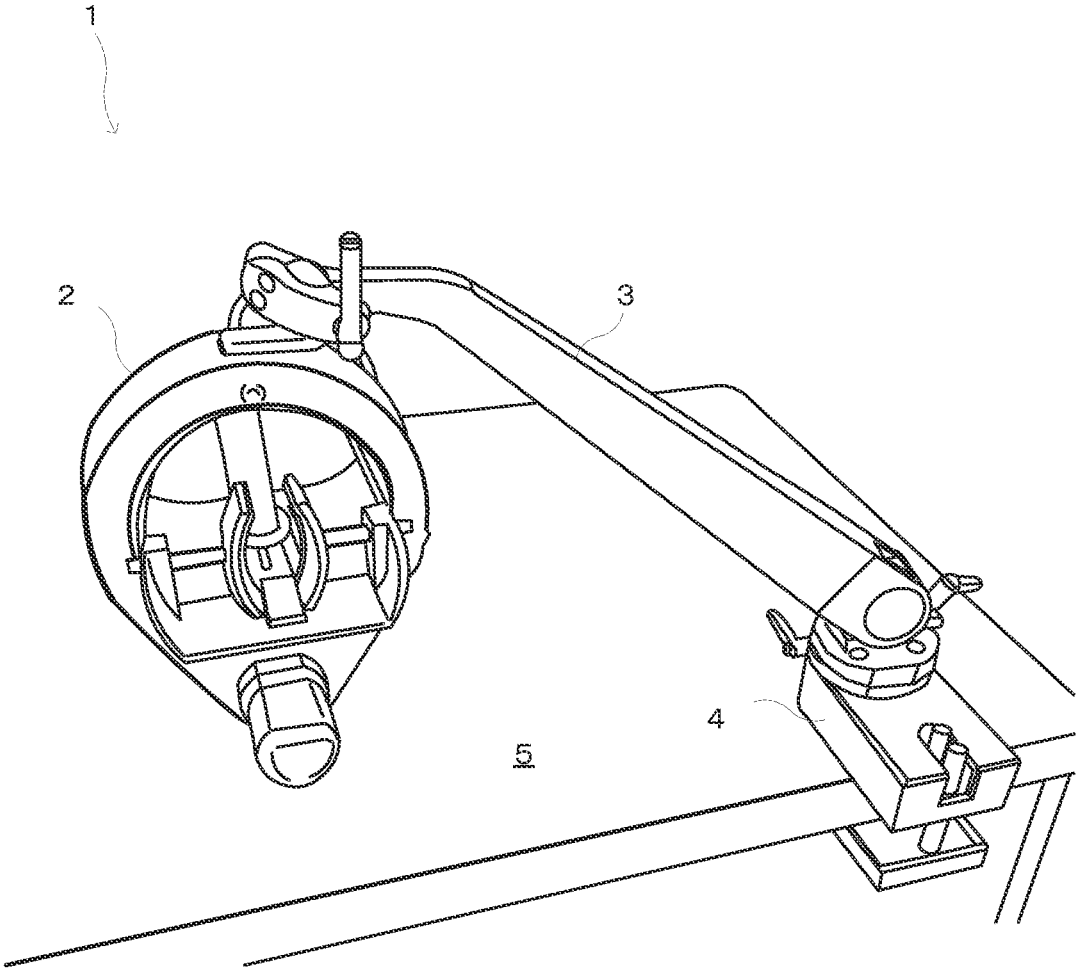
FIG. 1 is a perspective view illustrating a configuration of a hemiplegic forearm function recovery training device according to an embodiment of the present disclosure.

As illustrated in FIG. 1, a hemiplegic forearm function recovery training device 1 is a device for promoting recovery for a hemiplegic patient by training a paralyzed forearm S (see FIG. 9) of the patient. The hemiplegic forearm function recovery training device 1 includes a forearm mounting part 2, an arm part 3, and a mount 4. The forearm S of a subject is mounted on the forearm mounting part 2. The arm part 3 is a rod-like member extending in one direction. The mount 4 is attached to a desk 5.

A proximal end of the arm part 3 is attached to the mount 4. The forearm mounting part 2 is attached to a distal end of the arm part 3. The arm part 3 is rotatable with respect to the mount 4, and the forearm mounting part 2 is rotatable with respect to the arm part 3. Thus the hemiplegic forearm function recovery training device 1 enables the forearm mounting part 2 to be positioned in a place where the forearm S can be easily moved, with the mount 4 attached to the desk 5. The forearm mounting part 2 is positioned at such a place and the forearm S is mounted.

Figure 2:
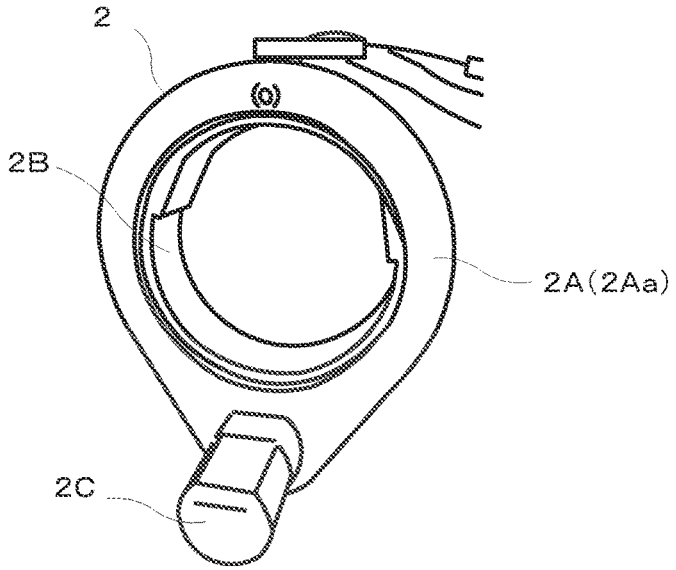
FIG. 2 is a perspective view illustrating an appearance of a forearm mounting part.

A configuration of the forearm mounting part 2 is first described. The forearm mounting part 2 includes an outer frame portion 2A, an inner frame portion 2B, and a control part 2C, as illustrated in FIG. 2. The inner frame portion 2B rotates with respect to the outer frame portion 2A by drive of the control part 2C.

Figure 3:
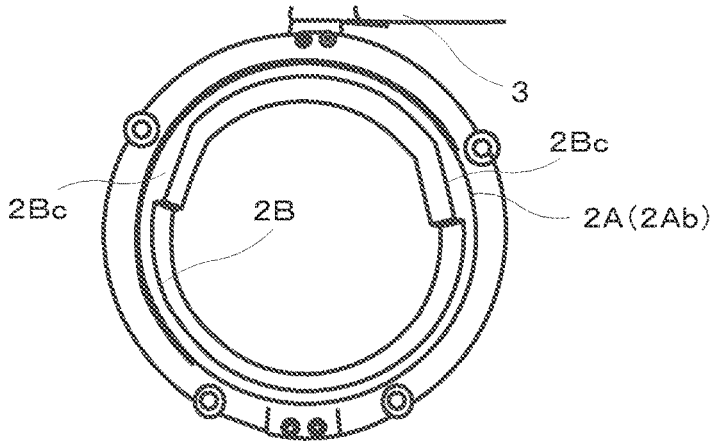
FIG. 3 is a perspective view illustrating an internal configuration of the forearm mounting part.

A housing 2Aa of the outer frame portion 2A is illustrated in FIG. 2. With this housing 2Aa removed, a rotation guide 2Ab of the outer frame portion 2A is externally exposed as illustrated in FIG. 3. The rotation guide 2Ab of the outer frame portion 2A is coupled to the arm part 3 at the uppermost portion. The rotation guide 2Ab is an annular member and guides the inner frame portion 2B in a circumferential direction of the rotation guide 2Ab.

Figure 4:
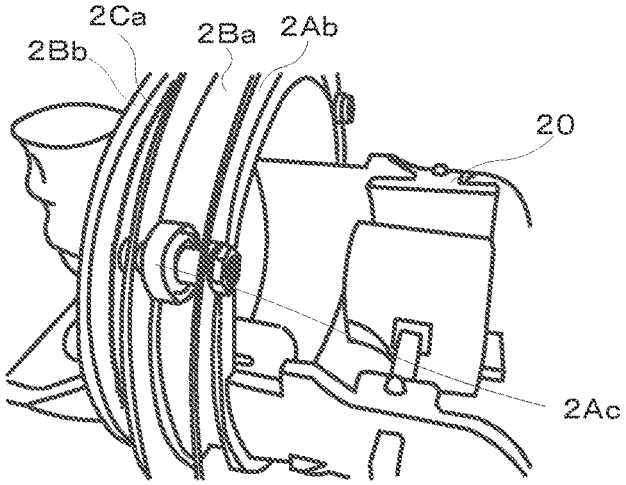
FIG. 4 is another perspective view illustrating the internal configuration of the forearm mounting part.

The rotation guide 2Ab of the outer frame portion 2A is provided with bearings 2Ac as illustrated in FIG. 4. The outer circumference of the inner frame portion 2B is correspondingly provided with grooves 2Ba that engage with the bearings 2Ac along the circumferential direction. The bearings 2Ac smoothly rotate the inner frame portion 2B while being fitted into the grooves 2Ba.

The inner frame portion 2B rotates along the rotation guide 2Ab. The inner frame portion 2B is provided with a pulley 2Bb around which a timing belt 2Ca of a control part 2C described later is wound. Grooves that engage with the timing belt 2Ca are formed in the outer circumference of the pulley 2Bb. The timing belt 2Ca engages with these grooves and the pulley 2Bb and the timing belt 2Ca rotate without slipping.

Figure 5:
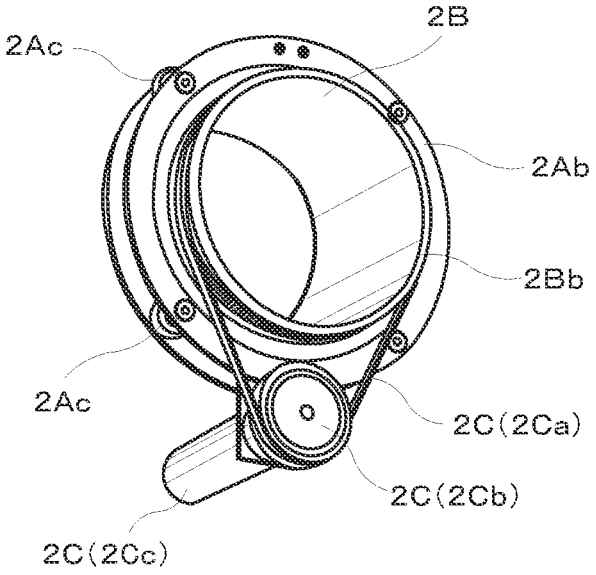
FIG. 5 is a still another perspective view illustrating the internal configuration of the forearm mounting part.

The control part 2C includes the timing belt 2Ca, a pulley 2Cb, and a rotation drive 2Cc, as illustrated in FIG. 5. The timing belt 2Ca is wound around the pulley 2Bb and the pulley 2Cb, and couples both of the pulleys to each other. The pulley 2Cb is connected to an axis of rotation of the rotation drive 2Cc.

The rotation drive 2Cc is attached to the outer frame portion 2A and has a motor and an encoder. As the motor of the rotation drive 2Cc rotates, the pulley 2Cb rotates, which via the timing belt 2Ca, causes the pulley 2Cb, that is, the inner frame portion 2B, to rotate with respect to the outer frame portion 2A. The encoder of the rotation drive 2Cc detects a rotation angle of the axis of rotation of the rotation drive 2Cc. Conversely, rotation of the inner frame portion 2B can cause the pulley 2Cb to rotate via the timing belt 2Ca.

The control part 2C controls rotation of the inner frame portion 2B. Specifically, the control part 2C performs a series of controls that repeatedly causes, by the motor, normal rotation, stop, reverse rotation, and stop of the inner frame portion 2B while acquiring, by the encoder, rotation angle information of the inner frame portion 2B. In the normal rotation, the control part 2C controls angular velocity or acceleration of the inner frame portion 2B to stimulate a training target muscle of the forearm that induces muscle tone and stress reflex upon the muscle tone. In the reverse rotation, the control part provides resistance to the inner frame portion 2B to sustain stimulation to the training target muscle to maintain the muscle tone.

Figure 6:
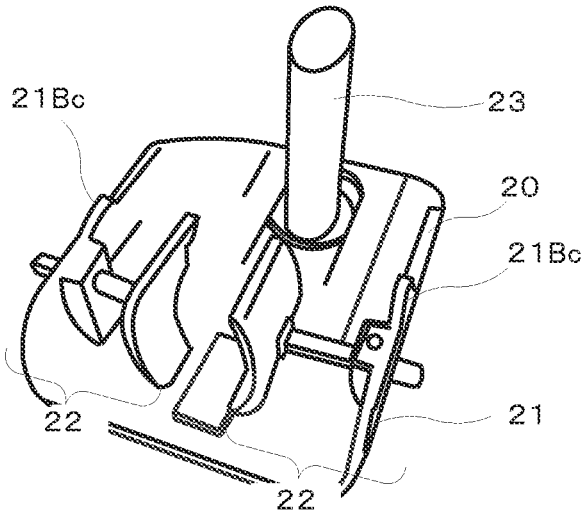
FIG. 6 is a perspective view illustrating a configuration of a mounting body.

As illustrated in FIG. 4, the forearm mounting part 2 includes a mounting body 20. The mounting body 20 with the forearm S mounted thereon is fitted into the inner frame portion 2B. Fitting of the mounting body 20 enables rotation of the inner frame portion 2B around the forearm S. As illustrated in FIG. 6, the mounting body 20 includes the base portion 21, the forearm fixing portion 22, and the gripping mechanism 23.

Figure 7:
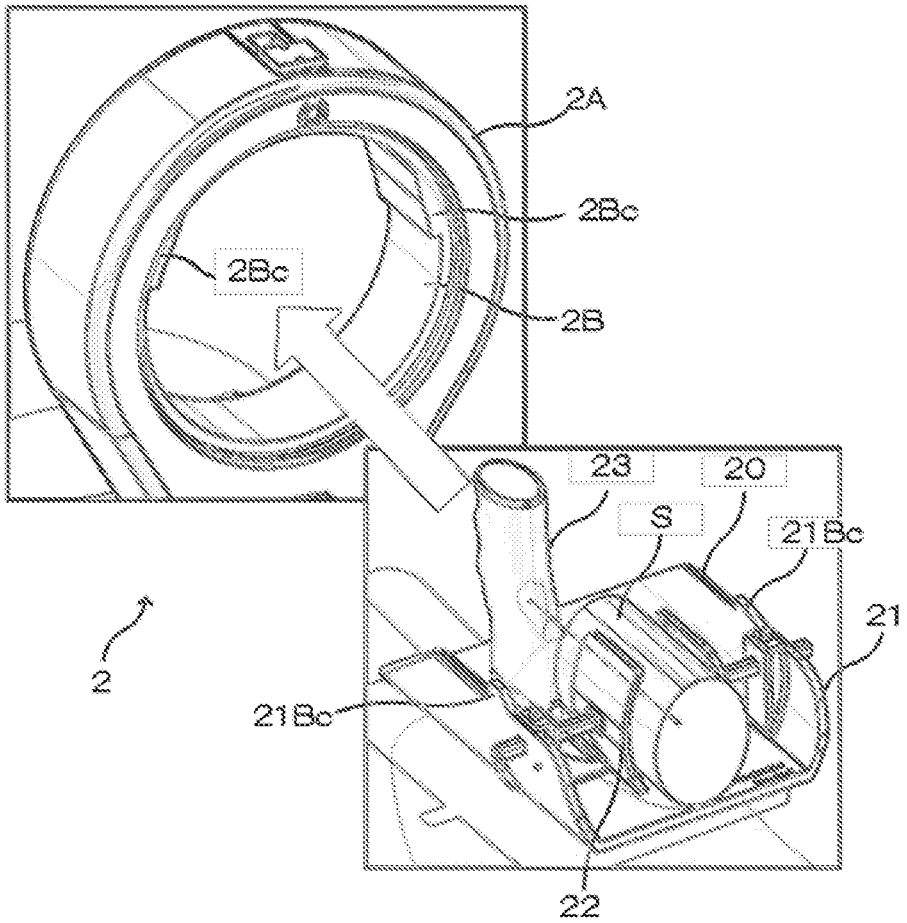
FIG. 7 is a drawing illustrating how the mounting body is fitted into an inner frame portion.
Figure 8:
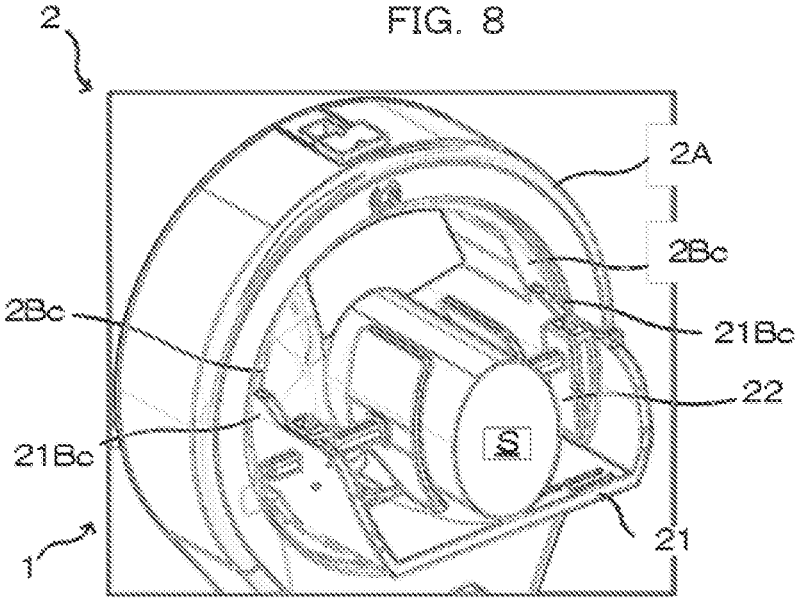
FIG. 8 is a drawing illustrating how the mounting body is fitted into the inner frame portion.

The base portion 21 is fitted into the inner frame portion 2B as illustrated in FIG. 7. The inner frame portion 2B is provided on the inner side thereof with a pair of protrusions 2Bc protruding inwardly. By contrast, the base portion 21 is provided with a pair of protrusions 21Bc. As illustrated in FIG. 7, insertion of the mounting body 20 into the inner frame portion 2B brings the pair of protrusions 2Bc of the inner frame portion 2B and the pair of protrusions 21Bc of the mounting body 20 into abutment against each other in an insertion direction of the mounting body 20 and a rotation direction of the inner frame portion 2B, as illustrated in FIG. 8. This enables the mounting body 20 and the inner frame portion 2B to rotate together with respect to the outer frame portion 2A.

Figure 9:
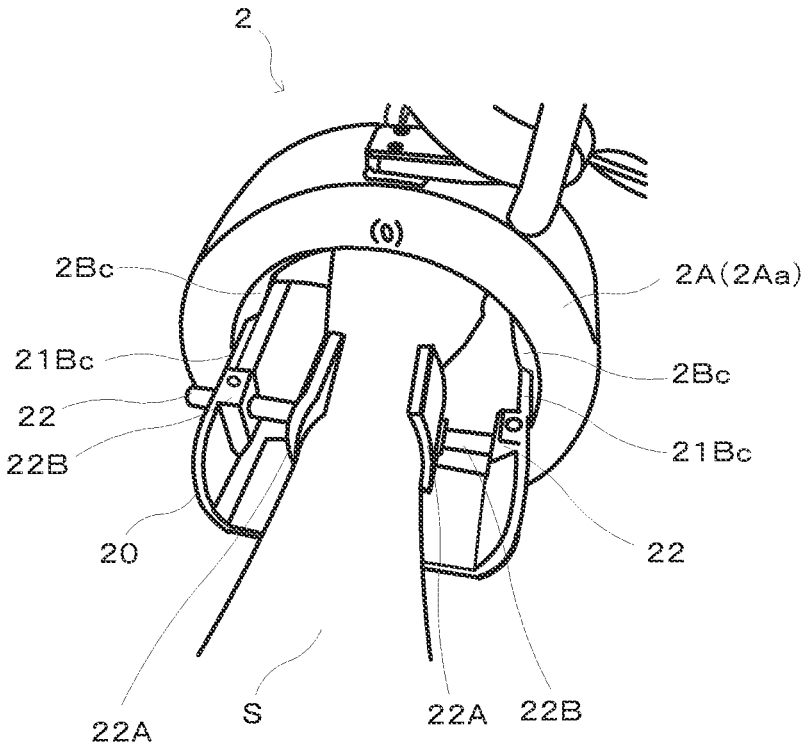
FIG. 9 is a view illustrating the mounting body on which the forearm is placed.
Figure 10:
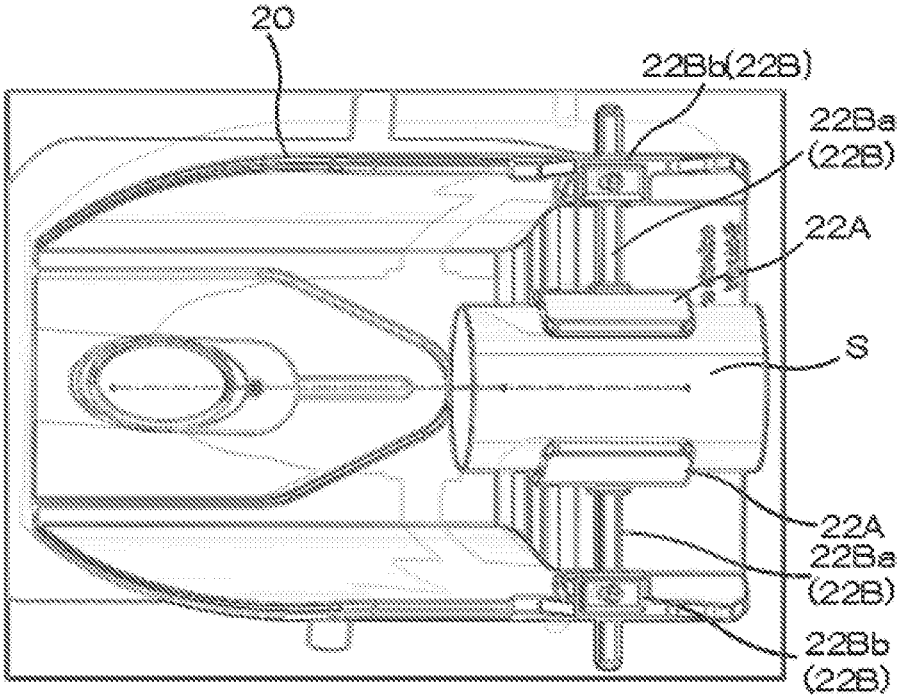
FIG. 10 is a top view of the mounting body.

The forearm fixing portion 22 fixes the forearm S as illustrated in FIG. 9. The forearm fixing portion 22 includes a pair of pad portions 22A and a pair of ratchet mechanisms 22B. As illustrated in FIG. 10, the paired pad portions 22A are disposed to face each other and hold the forearm S from the opposite sides. The ratchet mechanisms 22B are attached to a base portion 21 to enable the corresponding pad portions 22A to be pushed against the forearm S and enable the pushing against the forearm S to be released with a one-touch manipulation.

Figure 11:
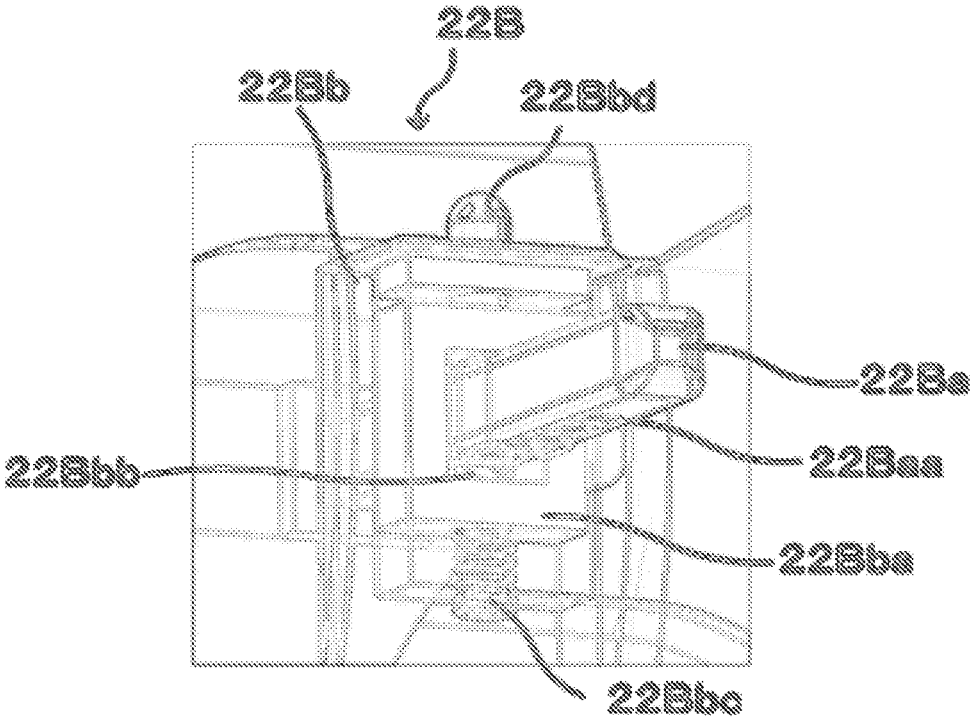
FIG. 11 is a transparent view illustrating an internal configuration of a ratchet mechanism.

As illustrated in FIG. 10, the ratchet mechanisms 22B each include a slider 22Ba and a case 22Bb. As illustrated in FIG. 11, the case 22Bb includes a locking frame 22Bba, a protrusion 22Bbb, a spring 22Bbc, and an unlock 22Bbd. The slider 22Ba is a rod-like body and has one end to which the pad portion 22A is attached. The slider 22Ba has an underside with holes 22Baa formed along the longitudinal direction. The locking frame 22Bba is inserted into a rectangular internal space of the case 22Bb. The locking frame 22Bba is a rectangular-shaped frame in which the slider 22Ba passes. The protrusion 22Bbb is provided in the frame of the locking frame 22Bba. Insertion of the protrusion 22Bbb into the hole 22Baa of the slider 22Ba positions the slider 22Ba.

Figure 12A:
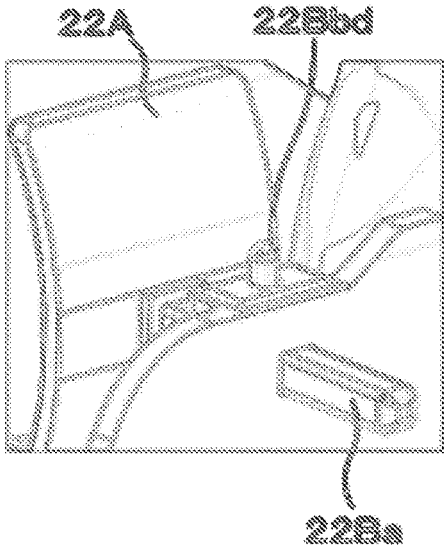
FIG. 12A is a schematic diagram illustrating an operation of the ratchet mechanism.
Figure 12B:
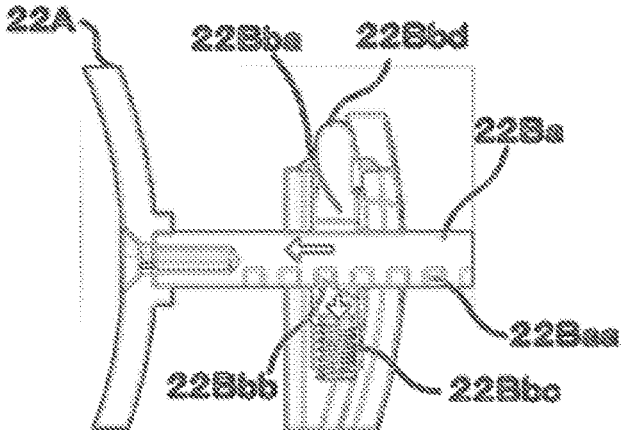
FIG. 12B is another schematic diagram illustrating the operation of the ratchet mechanism.
Figure 12C:
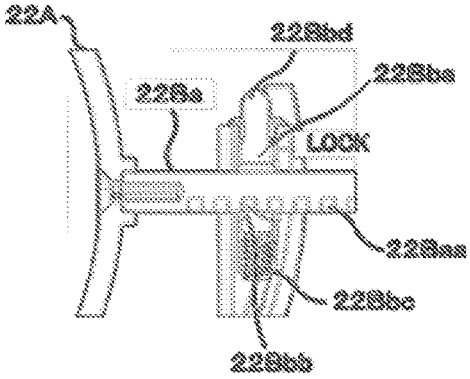
FIG. 12C is still another schematic diagram illustrating the operation of the ratchet mechanism.

The unlock 22Bbd is provided on a top of the locking frame 22Bba. A pad portion 22A side of the protrusion 22Bbb is orthogonal to a direction of movement of the slider 22Ba, and the other side opposite to the pad portion 22A side thereof inclines with respect to the direction of movement of the slider 22Ba. Thus, as illustrated in FIG. 12A, even when the unlock 22Bbd is unpressed, the slider 22Ba can slide toward the pad portion 22A side as illustrated in FIG. 12B, while the slider 22Ba is restricted from sliding toward the side opposite to the pad portion 22A side as illustrated in FIG. 12C.

Figure 12D:
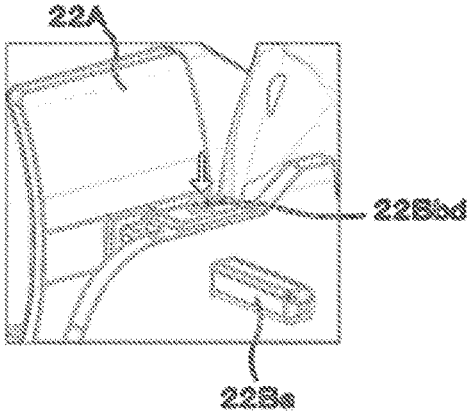
FIG. 12D is still yet another schematic diagram illustrating the operation of the ratchet mechanism.
Figure 12E:
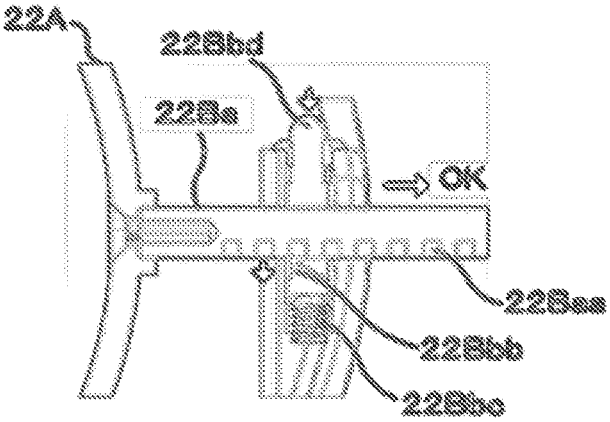
FIG. 12E is still yet another schematic diagram illustrating the operation of the ratchet mechanism.

The locking frame 22Bba is supported by the spring 22Bbc and vertically displaceable in the internal space of the case 22Bb. Thus, as illustrated in FIGS. 12D and 12E, when the unlock 22Bbd is pressed, the locking frame 22Bba moves downward and locking between the protrusion 22Bbb and the hole 22Baa is released, and then the slider 22Ba can be slid toward the side opposite to the pad portion 22A side.

In this way, the forearm fixing portion 22 can easily sandwich the forearm between the paired pad portions 22A by the ratchet mechanisms 22B.

Figure 13:
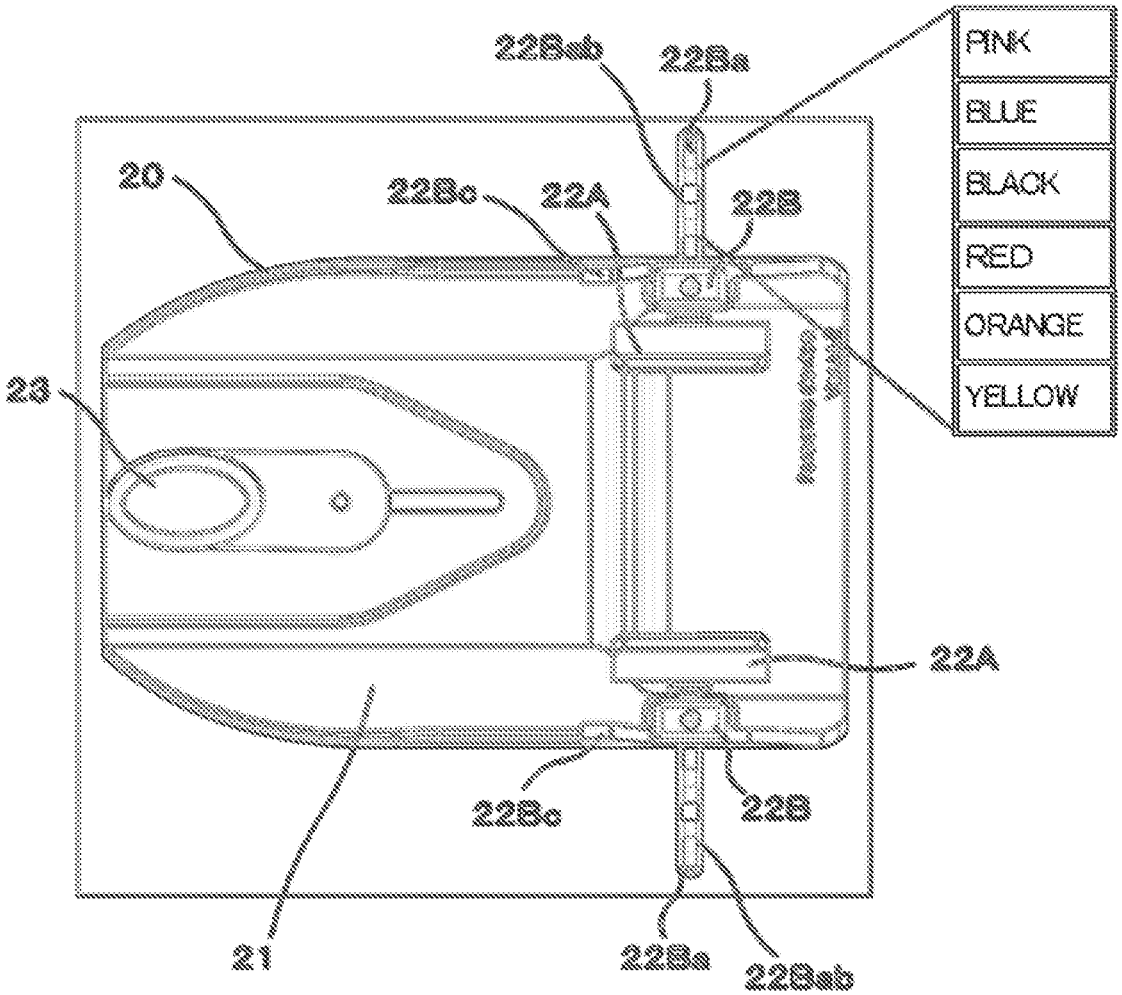
FIG. 13 is a drawing illustrating an example of marks provided on the forearm fixing portion.

The slider 22Ba is provided with marks 22Bab. As illustrated in FIG. 13, the marks 22Bab are colored and a pattern of colors expresses marks. The marks 22Bab help provide easy alignment of the forearm S with the center of the mounting body 20. Coloring of the marks 22Bab is not necessarily made and the marks 22Bab may be marks with an arrangement of equally spaced lines.

Figure 14A:
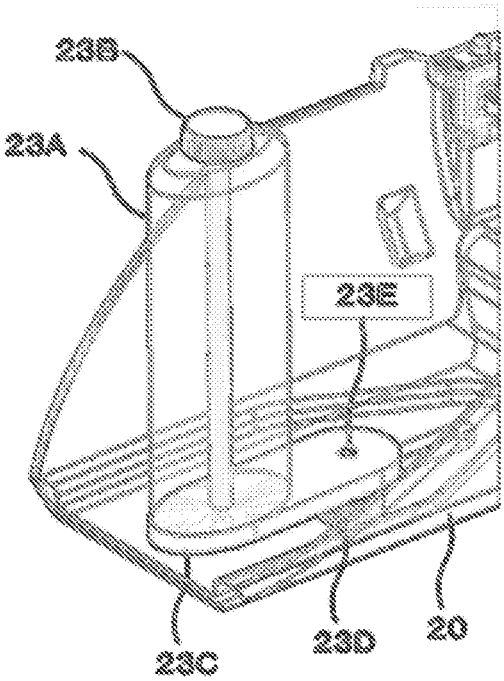
FIG. 14A is a schematic diagram illustrating an internal configuration of a gripping mechanism.
Figure 14B:
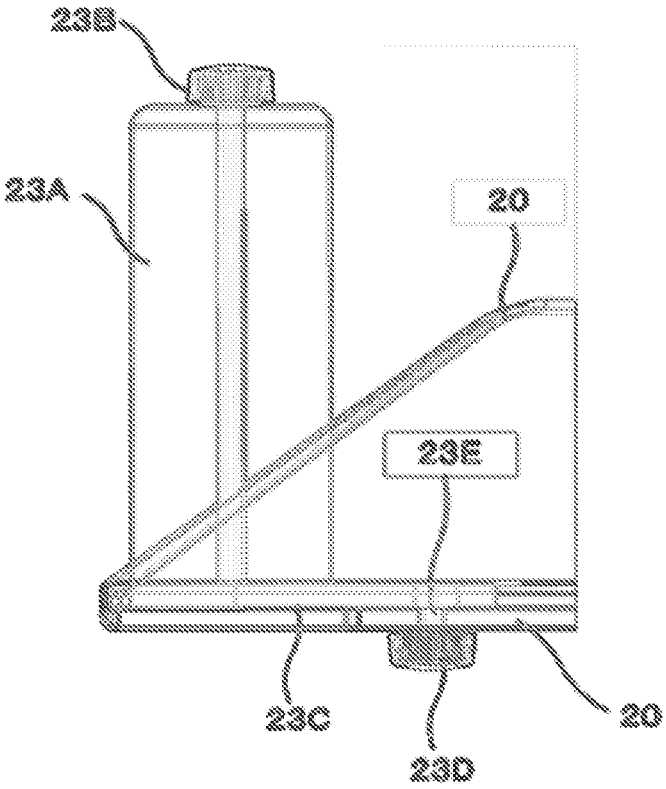
FIG. 14B is another schematic diagram illustrating the internal configuration of the gripping mechanism.

The gripping mechanism 23 is positioned to be grippable by a hand of the forearm S, with the forearm S fixed to the forearm fixing portion 22. As illustrated in FIGS. 14A and 14B, the gripping mechanism 23 includes a grip portion 23A, a first adjustment mechanism 23B, a second adjustment mechanism 23C, and a third adjustment mechanism 23D.

Figure 15:
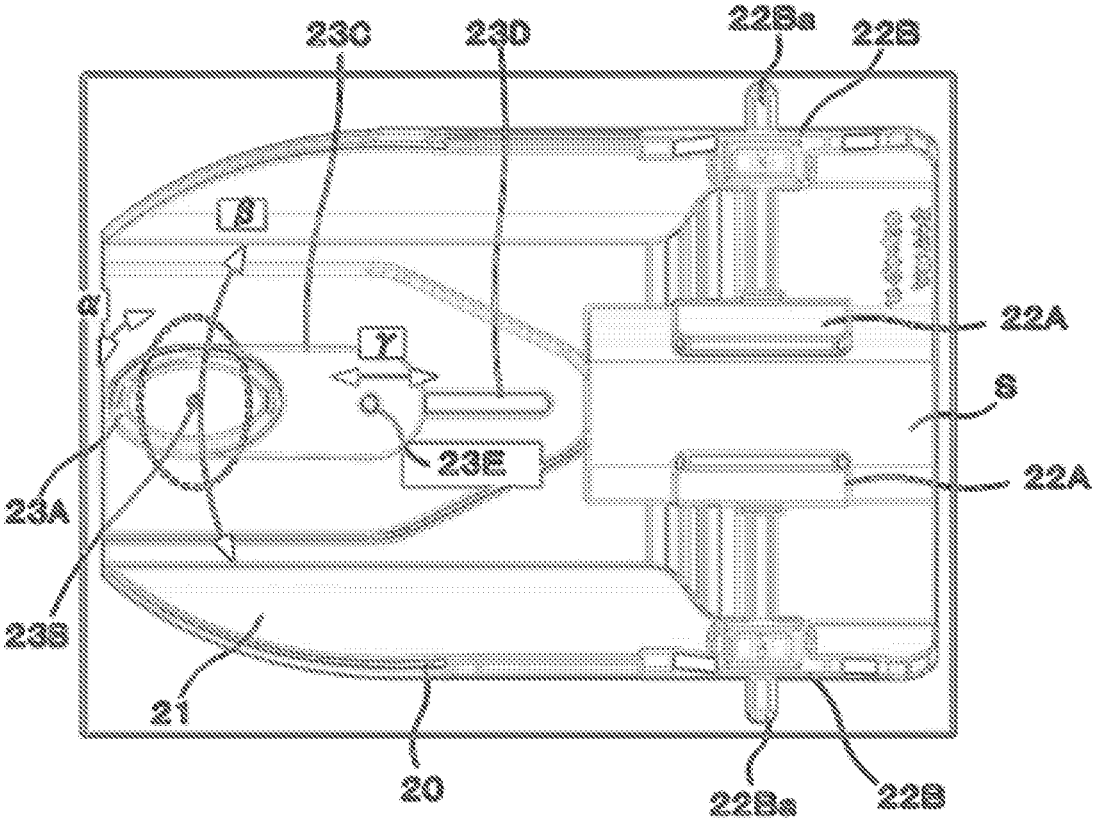
FIG. 15 is a schematic diagram illustrating how an adjustment is made by an adjustment mechanism of the gripping mechanism.

The grip portion 23A is a rod-like member extending in one direction to be capable of being gripped by the hand located at a front-end of the forearm S. The cross section of the grip portion 23A that is orthogonal to the longitudinal direction has an elliptic or oval shape. The first adjustment mechanism 23B adjusts a rotation position of the grip portion 23A around an axis of rotation (rotation direction indicated by arrows $\alpha$) extending in the longitudinal direction, as illustrated in FIG. 15. The first adjustment mechanism 23B can fix an orientation of the grip portion 23A. This first adjustment mechanism 23B can position the orientation (rotation position) of the grip portion 23A and adjust the width of the grip portion 23A to be easily gripped by the hand.

The second adjustment mechanism 23C adjusts offset of the grip portion 23A with respect to the central axis that is a center of rotation of the inner frame portion 2B. Specifically, the second adjustment mechanism 23C is a plate-like member that is rotatable around the rotation central axis 23E, and adjusts offset of the grip portion 23A by rotation (rotation in a direction indicated by arrows $\beta$) of the plate-like member. The second adjustment mechanism 23C can fix a position of the grip portion 23A in a direction indicated by arrows $\beta$. This second adjustment mechanism 23C can position the grip portion 23A to be able to be easily gripped in accordance with an angle of the wrist of the forearm S.

The third adjustment mechanism 23D adjusts a position of the grip portion 23A relating to a direction of the central axis (direction indicated by arrows $\gamma$) that is the center of rotation of the inner frame portion 2B. Specifically, movement of the rotation central axis 23E in the direction indicated by arrows $\gamma$ adjusts movement of the grip portion 23A. The third adjustment mechanism 23D can fix a position of the grip portion 23A in the direction indicated by arrows $\gamma$. This third adjustment mechanism 23D can position the grip portion 23A to be able to be easily gripped in accordance with a length (distance) of the forearm S.

This gripping mechanism 23 can adjust the orientation and the position of the grip portion 23A to be easily gripped by the hand. The hemiplegic forearm function recovery training device 1 according to the present embodiment is described as including the first adjustment mechanism 23B, the second adjustment mechanism 23C, and the third adjustment mechanism 23D, but may include any one of those adjustment mechanisms.

Figure 16A:
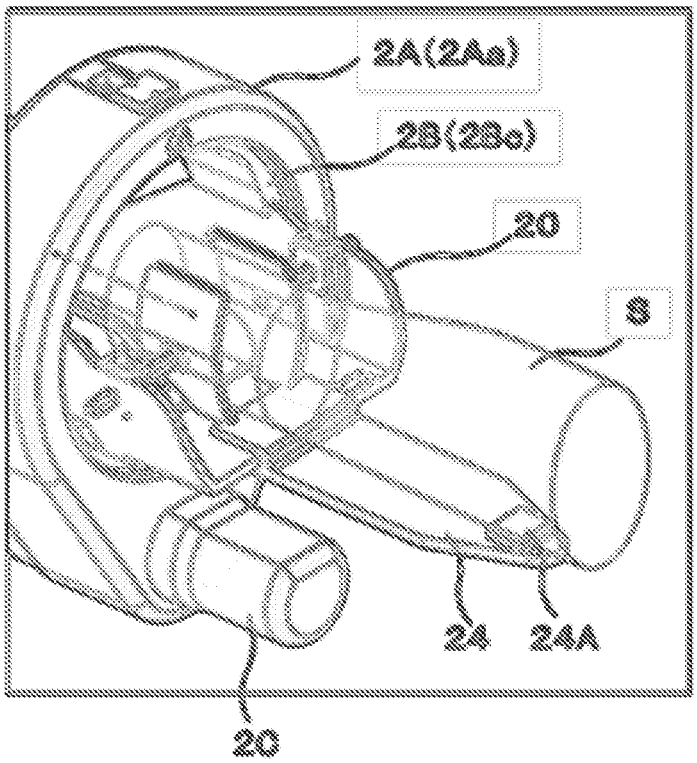
FIG. 16A is a drawing illustrating an example of installation of an elbow mount.
Figure 16B:
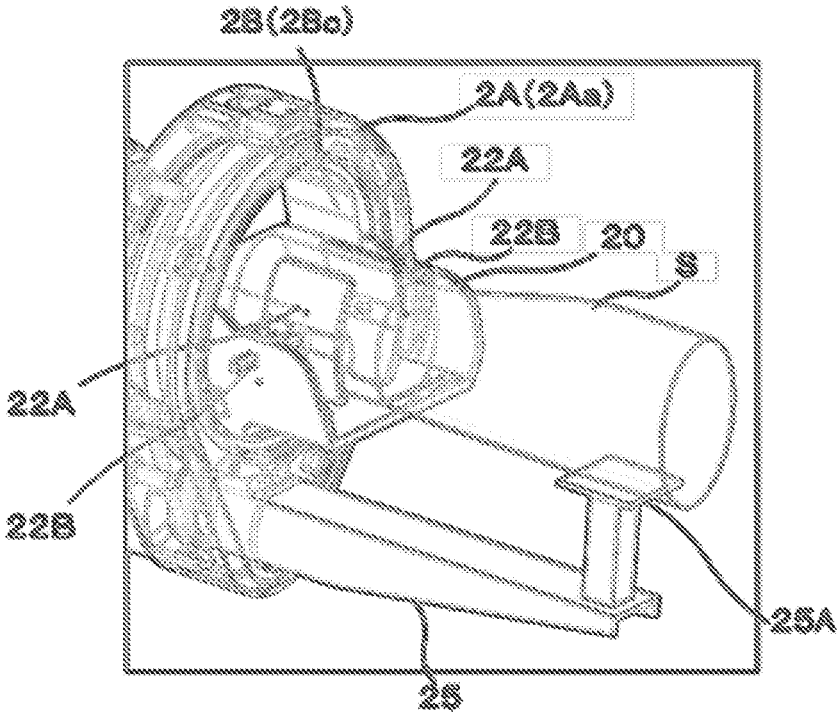
FIG. 16B is a drawing illustrating another example of installation of the elbow mount.

As illustrated in FIG. 16A, an elbow mount 24 may be attached to the mounting body 20. The elbow mount 24 has a pad portion 24A at which the elbow is actually to be placed. As illustrated in FIG. 16B, an elbow mount 25 may be attached to the inner frame portion 2B. The elbow mount 25 has a pad portion 25A at which the elbow is actually to be placed. Thus providing the elbow mount 24, 25 can provide support without effort to the forearm S mounted on the forearm mounting part 2.

Figure 18:
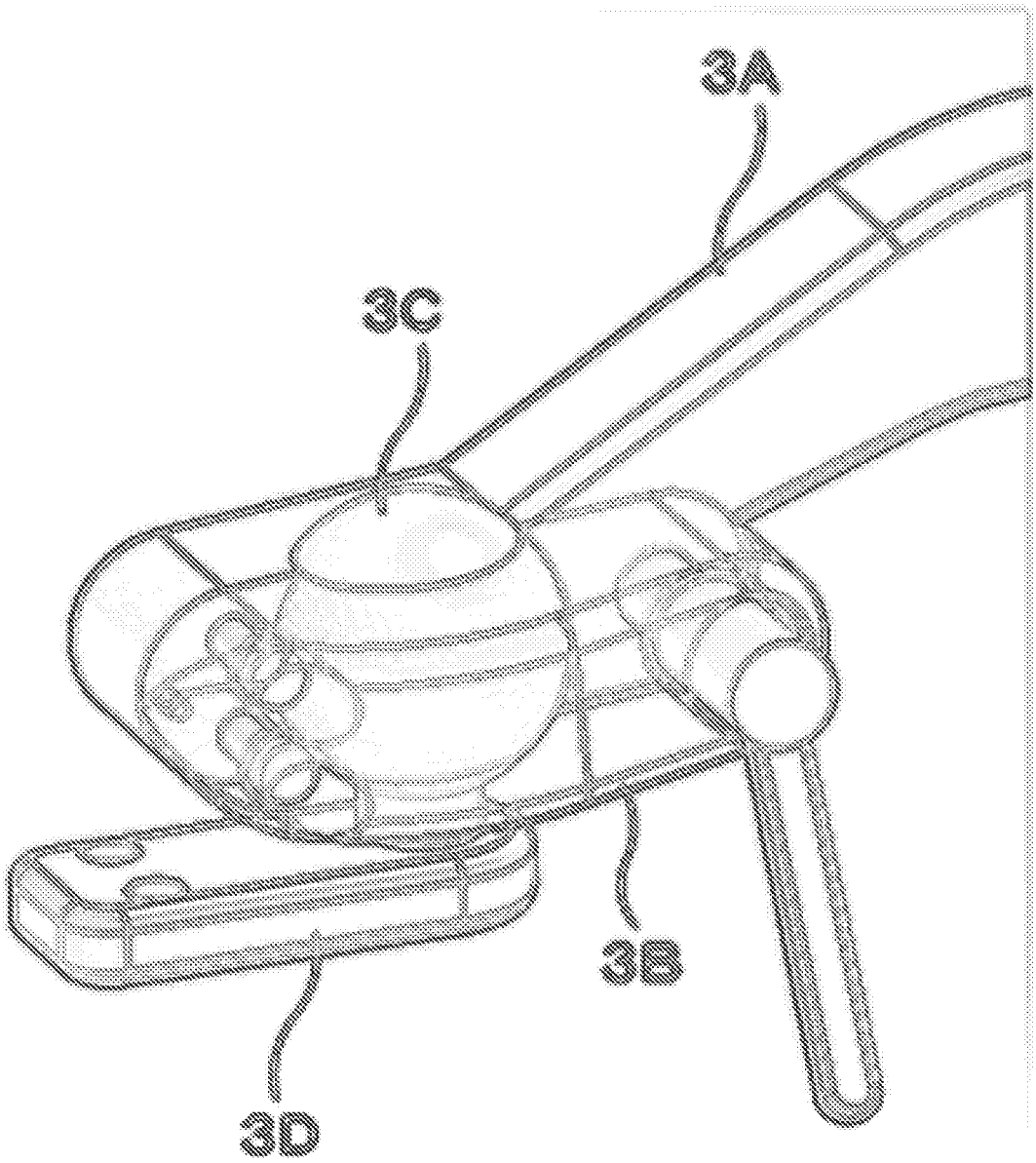
FIG. 18 is a schematic diagram illustrating an internal configuration of a joint between the forearm mounting part and an arm part.

Next, a configuration of the arm part 3 is described. As illustrated in FIG. 18, the arm part 3 includes an arm body 3A. The arm body 3A is a rod-like member extending in one direction from the proximal end portion toward the distal end.

The arm part 3 includes an end cover 3B, a spherical portion 3C, and a mount 3D at a portion of the arm part 3 that is coupled to the forearm mounting part 2. The end cover 3B, the spherical portion 3C, and the mount 3D constitute a first joint that connects the arm part 3 to the forearm fixing portion 22.

Figure 17A:
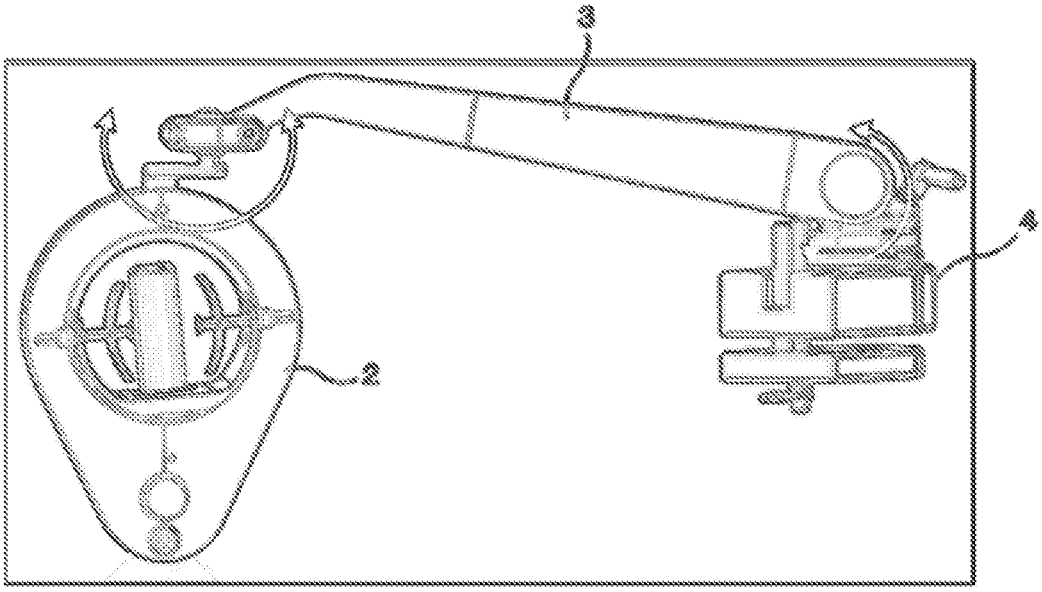
FIG. 17A is a schematic diagram illustrating a configuration of a hand portion.
Figure 17B:
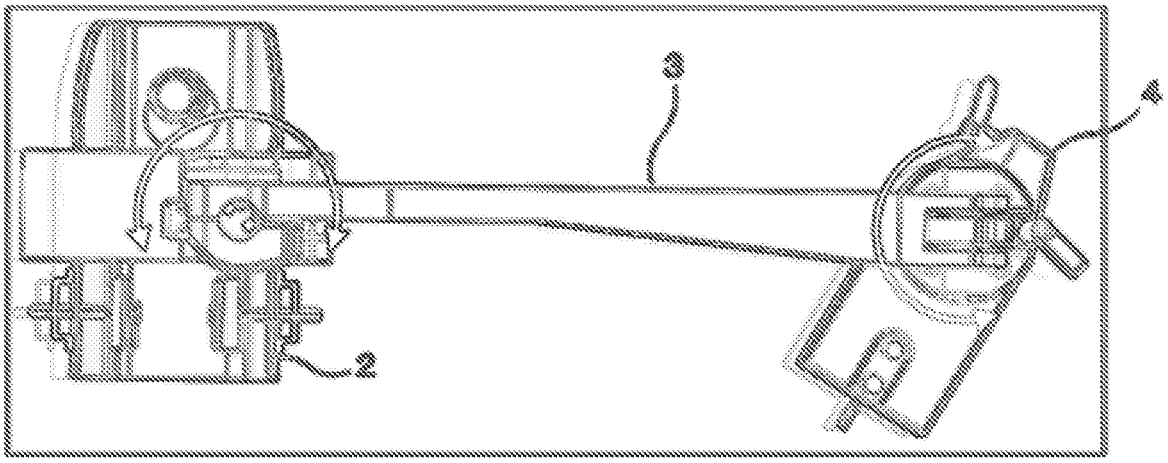
FIG. 17B is another schematic diagram illustrating the configuration of the hand portion.

The end cover 3B is attached to the arm body 3A, and the spherical portion 3C is rotatably sandwiched between the arm body 3A and the end cover 3B. The spherical portion 3C is integral with the mount 3D, and the forearm mounting part 2 is coupled with the mount 3D. Thus the spherical portion 3C enables the forearm mounting part 2 to rotate in 3 degrees of freedom with respect to the arm part 3, as illustrated in FIGS. 17A and 17B. The spherical portion 3C is secured by screws of the arm body 3A and the end cover 3B. The mount 3D and the spherical portion 3C are connected to each other not in a straight line but in a shifted manner. Thus rotation around the vertical direction of the spherical portion 3C enables fine adjustment of the distance.

Figure 19:
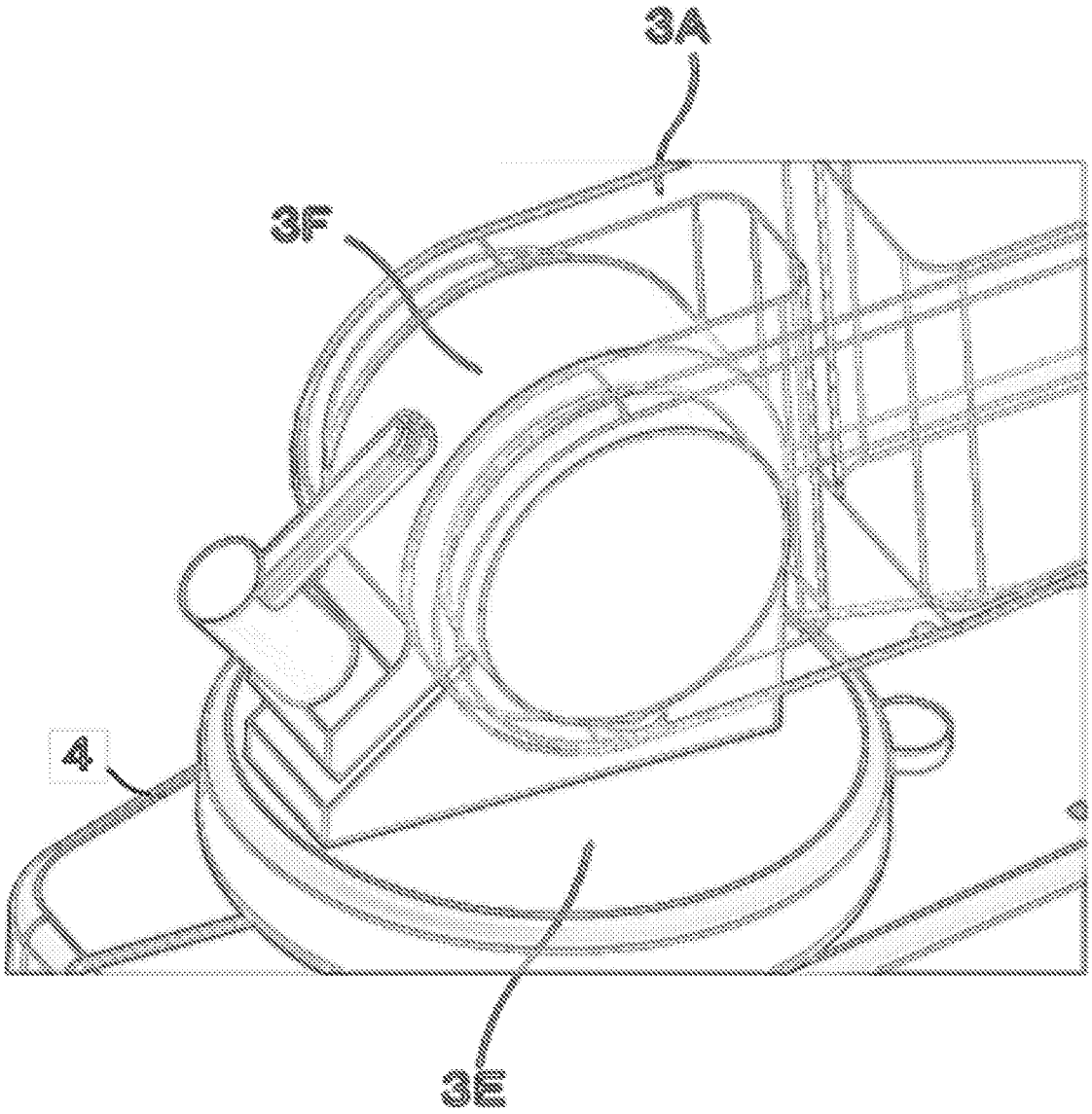
FIG. 19 is a schematic diagram illustrating an internal configuration of the joint between the arm part and a mount.

The arm part 3 includes a rotary portion 3E and a rotary portion 3F at a portion of the arm part 3 that is coupled to the mount 4, as illustrated in FIG. 19. The rotary portion 3E and the rotary portion 3F constitute a second joint. The rotary portion 3E has an axis of rotation that is perpendicular to an attachment surface (for example, the upper surface of a desk 5) of the mount 4, and rotates the arm part 3 around the axis of rotation. In addition, the rotary portion 3F rotates the arm part 3 around an axis of rotation that is perpendicular to the axis of rotation of the rotary portion 3E. This enables positional adjustment of the forearm mounting part 2 at the distal end of the arm part 3. The rotary portions 3E and 3F can fix, by screws, orientations of the arm part 3 in the axes of rotation of the rotary portions 3E and 3F.

In this way, the first joint and the second joint of the arm part 3 allow the position of the forearm fixing portion 22 to be adjusted in 5 degrees of freedom.

Figure 20:
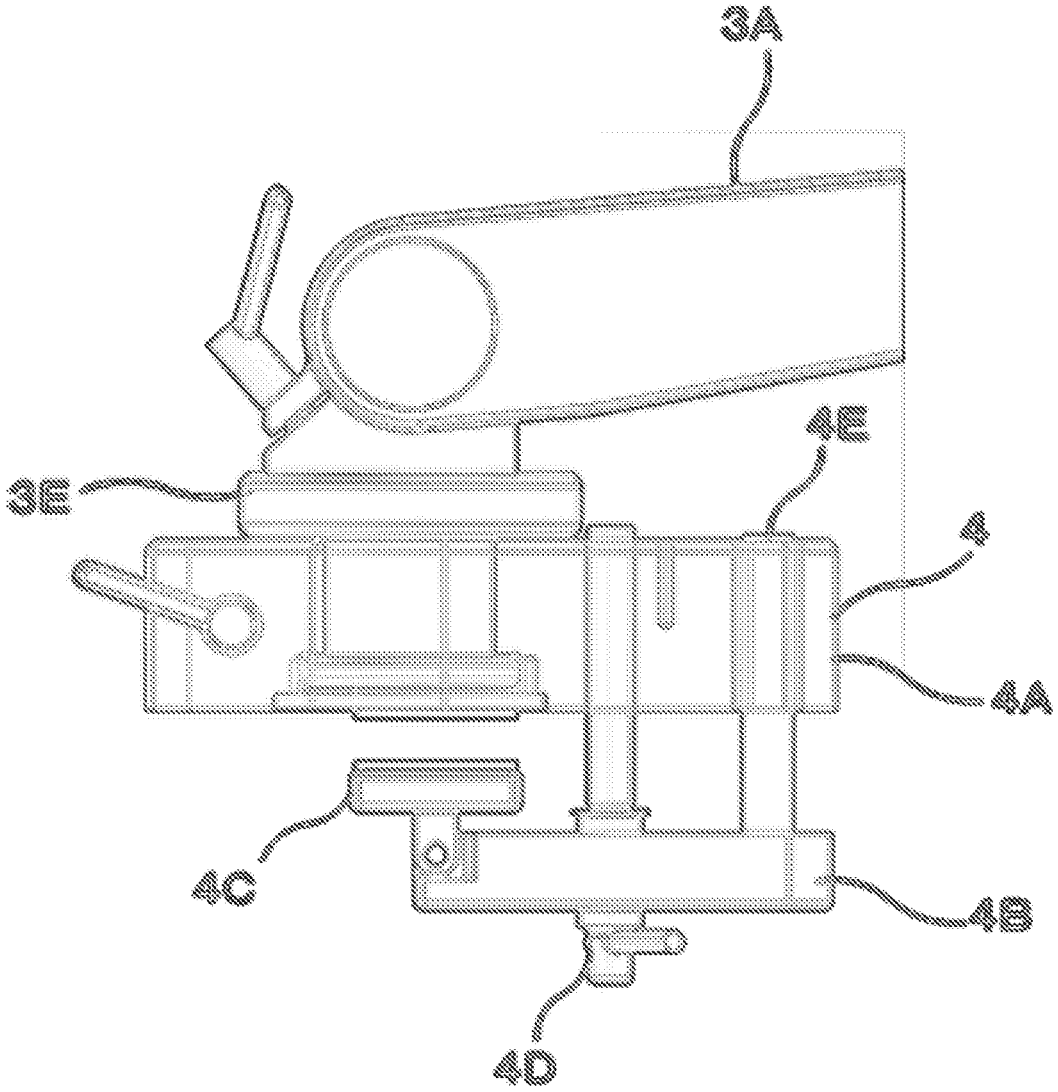
FIG. 20 is a schematic diagram illustrating an internal configuration of the mount.

Next, a configuration of the mount 4 is described. The mount 4 is a vice mechanism that can attach the proximal end portion (second joint) of the arm part 3 to a plate-like member (base) such as a desk 5. As illustrated in FIG. 20, the mount 4 includes a housing 4A, a lower plate 4B, a pad portion 4C, a fastener 4D, and an auxiliary fastener 4E.

Figure 21:
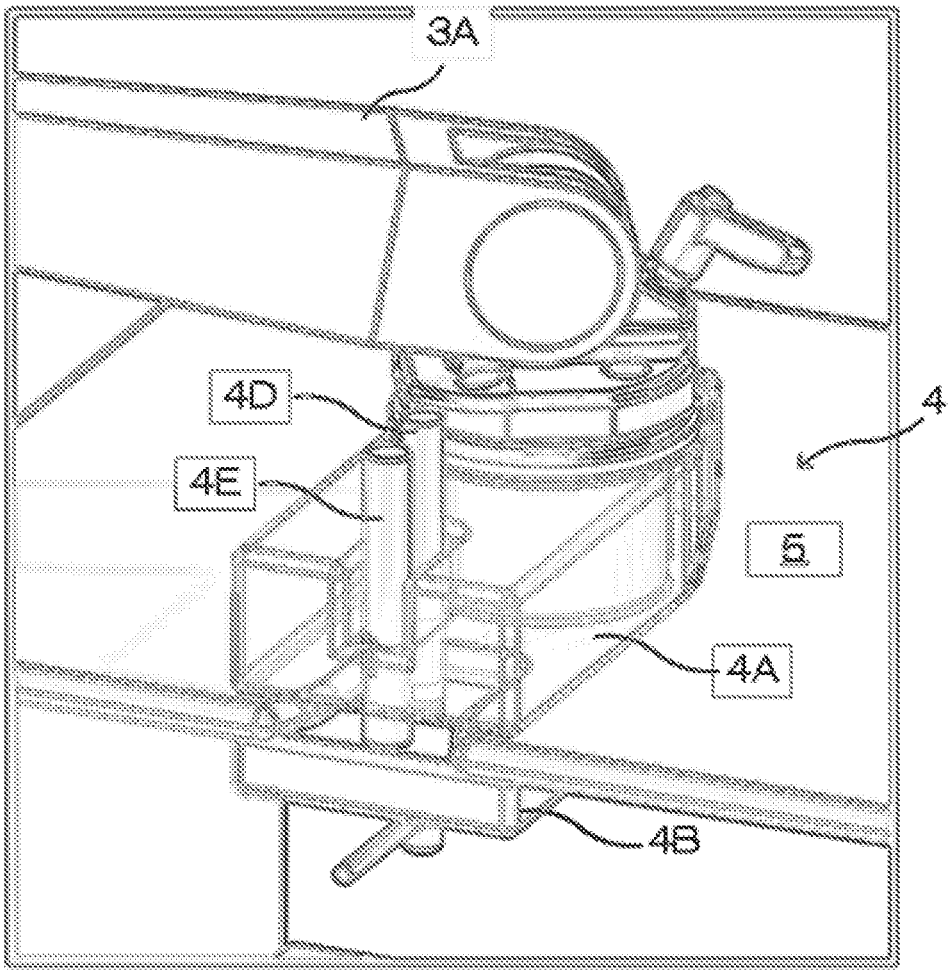
FIG. 21 is a schematic diagram illustrating the mount attached to a desk.

The arm part 3 is mounted on the housing 4A and the housing 4A is disposed on the desk 5 that is an attachment target. The lower plate 4B is disposed under the desk 5 that is the attachment target. The lower plate 4B has the pad portion 4C that abuts against the rear side of the plate of the desk 5. As illustrated in FIG. 21, the mount 4 is fixed to the desk 5 or the like by the plate of the desk 5 fastened by the fastener 4D and the auxiliary fastener 4E in a state where the plate of the desk 5 is sandwiched between the rear surface of the housing 4A and the lower plate 4B, that is, by desk surfaces being held between the rear surface of the housing 4A and the pad portion 4C.

Next, an operation of the hemiplegic forearm function recovery training device 1 is described.

Figure 22:
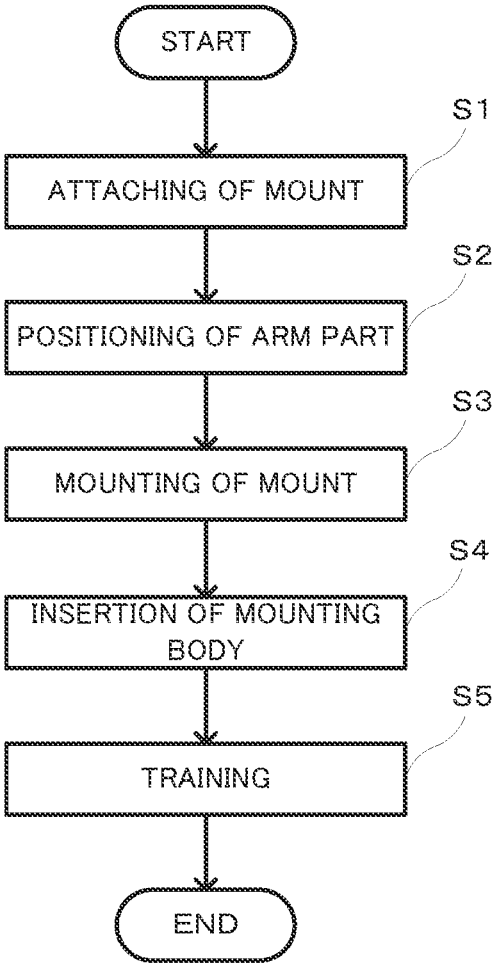
FIG. 22 is a flow chart for a method of using a hemiplegic forearm function recovery training device according to an embodiment of the present disclosure.

As illustrated in FIG. 22, first, the mount 4 is attached to the desk 5 or the like (Step S1; attachment step). Specifically, the housing 4A is placed on the upper side of the plate-like portion of the desk 5, and the lower plate 4B is placed on the lower side thereof. The plate-like portion of the desk 5 is then secured between the housing 4A and the lower plate 4B with the fastener 4D and the auxiliary fastener 4E to attach the mount 4 to the desk 5. The arm part 3 may be connected to the mount 4 before the attachment, or the arm part 3 may be connected to the mount 4 after fixing of the mount 4 to the desk 5.

Then the arm part 3 is moved to position the forearm mounting part 2 in an appropriate position (Step S2; positioning step). Specifically, after rotating the rotary portions 3E and 3F and determining a direction of extension of the arm part 3, the spherical portion 3C is rotated and an attitude of the forearm mounting part 2 is changed to position the forearm mounting part 2 in a position where the inserted forearm S can be easily moved.

Next, the forearm S is mounted on the mounting body 20 (Step S3; mounting step). First, the forearm S is placed on the base portion, with the grip portion 23A gripped by the hand. In a case in which gripping of the grip portion 23A is hard, the orientation and position of the grip portion 23A can be adjusted by the first adjustment mechanism 23B, the second adjustment mechanism 23C, and the third adjustment mechanism 23D.

Then the forearm S is fixed to the mounting body 20 using the forearm fixing portion 22. Specifically the sliders 22Ba of the pair of ratchet mechanisms 22B are slid in a direction of the forearm S to press the pad portion 22A against the forearm S. In this case, the forearm S is desirably placed at the center of the mounting body 20.

Next, the mounting body 20 is inserted in the inner frame portion 2B of the forearm mounting part 2 (Step S4; insertion step). Specifically, the mounting body 20 is inserted in the forearm mounting part 2 in such a way that the protrusion 21Bc of the mounting body 20 abuts the protrusion 2Bc of the inner frame portion 2B.

Next is the training of the forearm S (Step S5; control step). Specifically, the control part 2C performs a series of controls that repeatedly causes, by driving of the motor, normal rotation, stop, reverse rotation, and stop of the inner frame portion 2B while acquiring, by the encoder of the control part 2C, rotation angle information. In the normal rotation, the control part 2C controls angular velocity or acceleration of the inner frame portion 2B to stimulate a training target muscle of the forearm S that induces muscle tone and stress reflex upon the muscle tone. In the reverse rotation, the control part provides resistance to the inner frame portion 2B to sustain stimulation to the muscle to maintain the muscle tone.

This provides the forearm S, for example, with a passive excise of pronation (or supination) by sudden acceleration or with a voluntary active excise of supination (or pronation). Here, a facilitating stimulus by sudden acceleration in a pronation (or supination) direction is provided before voluntary supination (or pronation). The facilitating stimulus by sudden acceleration prompts stretch reflex, and effective training can be expected.

As described above, according to the present embodiment, the forearm mounting part 2 to which the forearm S is mounted has separate components that are the rotary inner frame portion 2B and the mounting body 20 to which the forearm S is mounted, and thereby only insertion of the mounting body 20 in the inner frame portion 2B after mounting of the forearm S to the mounting body 20 enables the forearm S to be easily mounted in the device. As a result, training can be effectively performed.

Furthermore, according to the present embodiment, the orientation and position of the grip portion 23A can be adjusted in accordance with states of bending and extending of a wrist, which provides easy gripping of the grip portion 23A by the hand. This can achieve efficient training.

Furthermore, according to the present embodiment, the forearm S is fixed to the mounting body 20 by the ratchet mechanism 22B, which facilitates fixing of the forearm S. This can achieve prompt fixing of the forearm S compared with fixing of the forearm S by screws without the ratchet mechanism 22B, and can release the fixing with a one-touch manipulation.

Furthermore, according to the present embodiment, the arm part 3 enables the forearm mounting part 2 to be positioned in a position where training is easily performed (where pronation and supination excises of the forearm are easily performed), which can maximize training effects.

Furthermore, according to the present embodiment, the mount 4 enables the hemiplegic forearm function recovery training device 1 to be installed at various places, which can enhance versatility. A power supply box and a control unit can be contained in a dedicated stand on which the mount is fixed, and an auxiliary stimulation device such as vibration/electrical stimulus can be further contained. Since such a dedicated stand may have a height lower than that of a common desk, the stand itself can be placed under the desk.

Figure 23A:
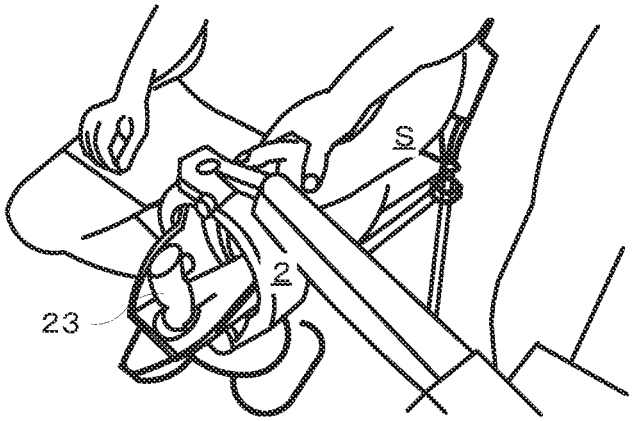
FIG. 23A is a view illustrating measurement of a time for mounting a forearm in a case in which a forearm mounting part is an integral and inseparable type of part.
Figure 23B:
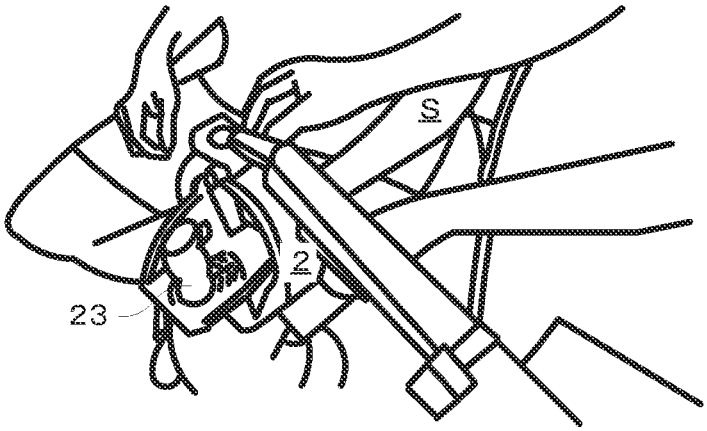
FIG. 23B is another view illustrating measurement of the time for mounting the forearm in the case in which the forearm mounting part is an integral and inseparable type of part.
Figure 23C:
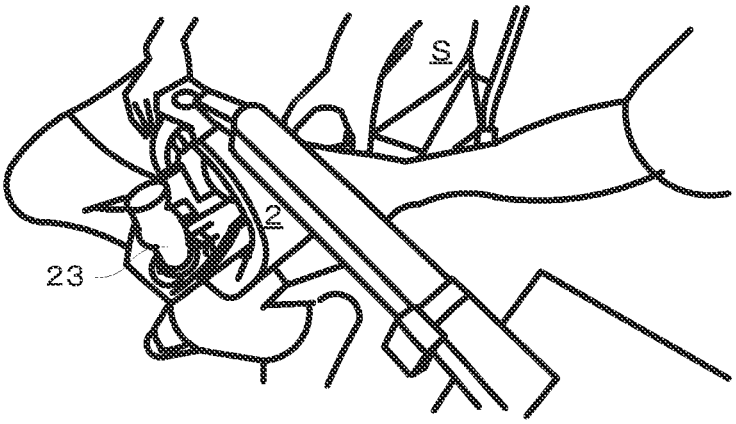
FIG. 23C is still another view illustrating measurement of the time for mounting the forearm in the case in which the forearm mounting part is an integral and inseparable type of part.
Figure 23D:
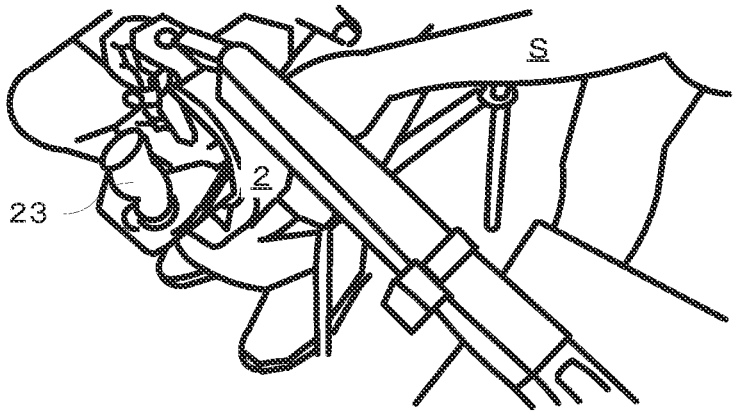
FIG. 23D is still yet another view illustrating measurement of the time for mounting the forearm in the case in which the forearm mounting part is an integral and inseparable type of part.
Figure 23E:
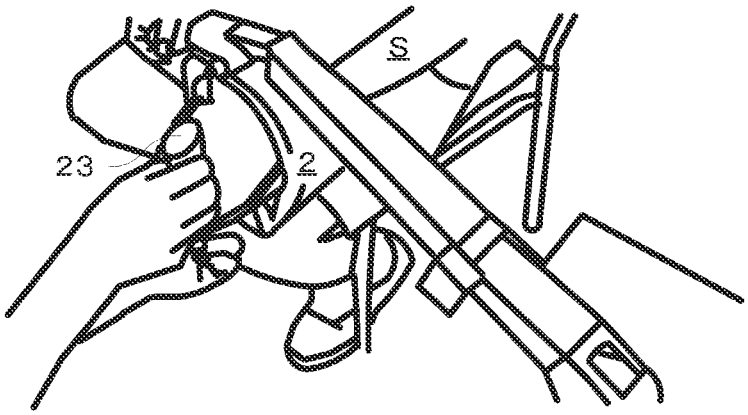
FIG. 23E is still yet another view illustrating measurement of the time for mounting the forearm in the case in which the forearm mounting part is an integral and inseparable type of part.
Figure 23F:
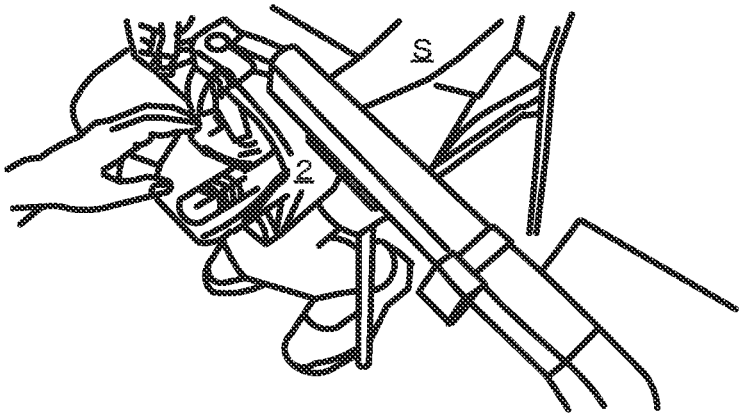
FIG. 23F is still yet another view illustrating measurement of the time for mounting the forearm in the case in which the forearm mounting part is an integral and inseparable type of part.
Figure 23G:
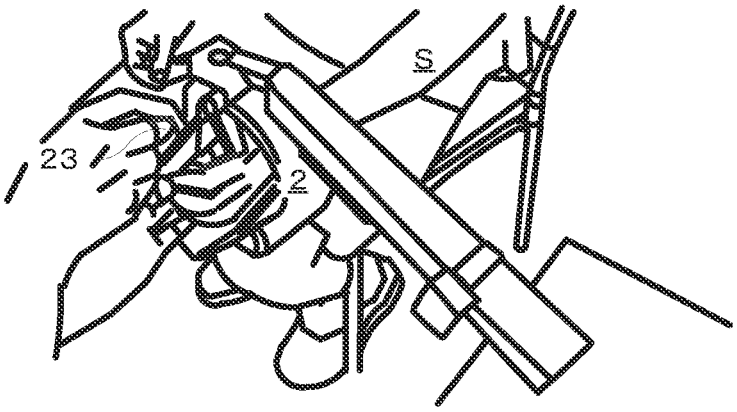
FIG. 23G is still yet another view illustrating measurement of the time for mounting the forearm in the case in which the forearm mounting part is an integral and inseparable type of part.
Figure 23H:
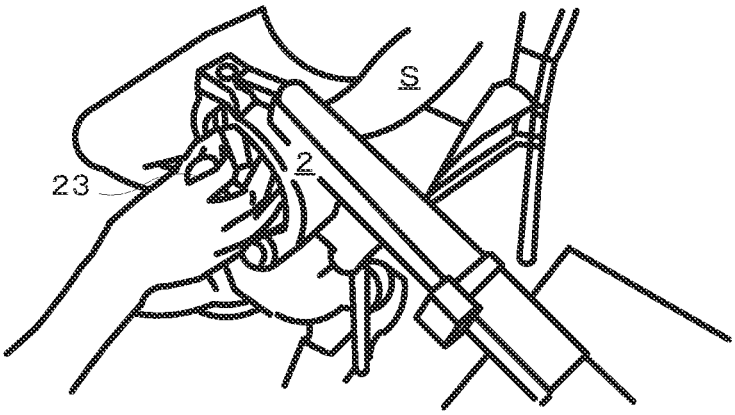
FIG. 23H is still yet another view illustrating measurement of the time for mounting the forearm in the case in which the forearm mounting part is an integral and inseparable type of part.
Figure 23I:
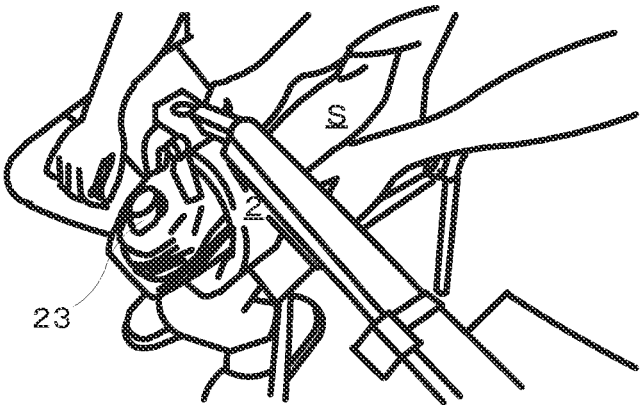
FIG. 23I is still yet another view illustrating measurement of the time for mounting the forearm in the case in which the forearm mounting part is an integral and inseparable type of part.

As illustrated in FIGS. 23A to 23I, a mounting time required for mounting the forearm S in a case in which the forearm mounting part 2 is an integral and inseparable type of part was measured. The forearm S was placed in front of the forearm mounting part 2 to start the mounting (FIG. 23A; 00 min 00 sec). Forearm S was inserted in the forearm mounting part 2 while the wrist was being extended (FIG. 23B; 00 min 15 sec). Keeping the forearm S forward in the forearm mounting part 2 (FIG. 23C; 00 min 25 sec) might cause the hand to strike the gripping mechanism 23 (FIG. 23D; 00 min 41 sec). Thus the gripping mechanism 23 was removed (FIGS. 23E and 23F; 00 min 41 sec to 00 min 44 sec), and then the hand was open to let the gripping mechanism in (FIG. 23G; 00 min 50 sec) and the gripping mechanism 23 was fixed (FIG. 23H; 01 min 02 sec). Then the wrist was fixed and the mounting was completed (FIG. 23I; 01 min 28 sec). In such a case in which the forearm S was mounted in the integral type of forearm mounting part 2, it took 1 min 28 sec.

Figure 24A:
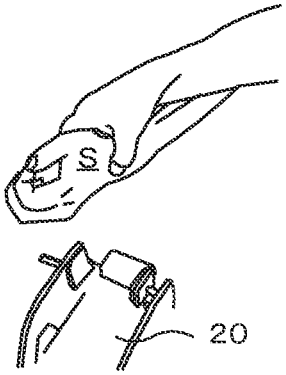
FIG. 24A is a view illustrating measurement of a time for mounting a forearm in a case in which the hemiplegic forearm function recovery training device according to the present embodiment is used.
Figure 24B:
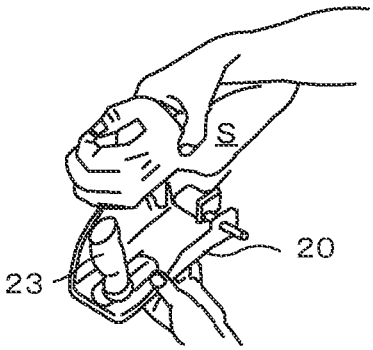
FIG. 24B is another view illustrating measurement of the time for mounting the forearm in the case in which the hemiplegic forearm function recovery training device according to the present embodiment is used.
Figure 24C:
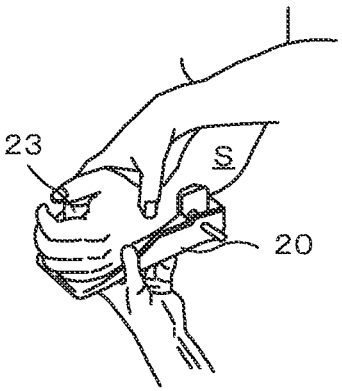
FIG. 24C is still another view illustrating measurement of the time for mounting the forearm in the case in which the hemiplegic forearm function recovery training device according to the present embodiment is used.
Figure 24D:
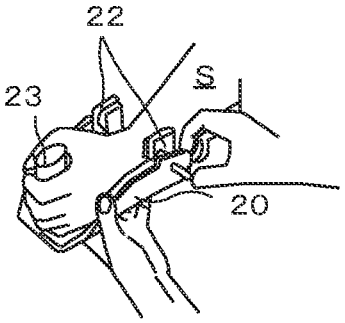
FIG. 24D is still yet another view illustrating measurement of the time for mounting the forearm in the case in which the hemiplegic forearm function recovery training device according to the present embodiment is used.
Figure 24E:
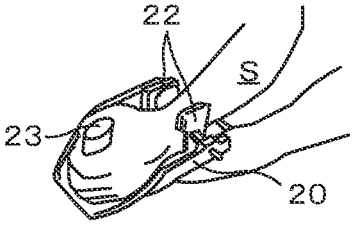
FIG. 24E is still yet another view illustrating measurement of the time for mounting the forearm in the case in which the hemiplegic forearm function recovery training device according to the present embodiment is used.
Figure 24F:
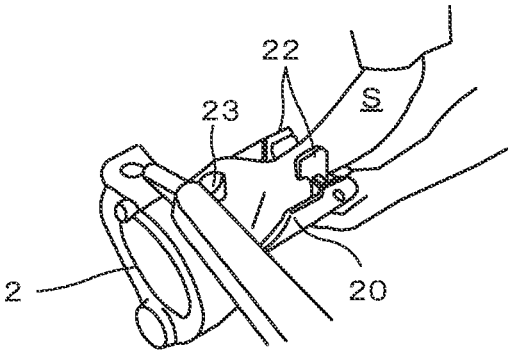
FIG. 24F is still yet another view illustrating measurement of the time for mounting the forearm in the case in which the hemiplegic forearm function recovery training device according to the present embodiment is used.
Figure 24G:
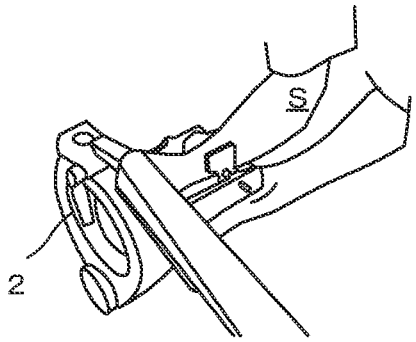
FIG. 24G is still yet another view illustrating measurement of the time for mounting the forearm in the case in which the hemiplegic forearm function recovery training device according to the present embodiment is used.
Figure 24H:
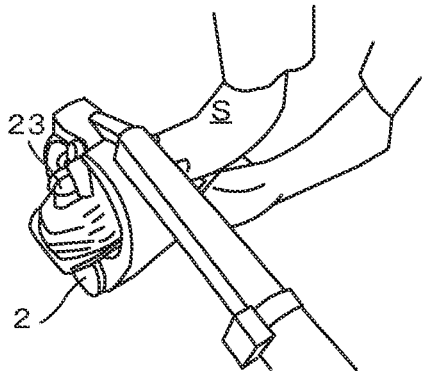
FIG. 24H is still yet another view illustrating measurement of the time for mounting the forearm in the case in which the hemiplegic forearm function recovery training device according to the present embodiment is used.
Figure 24I:
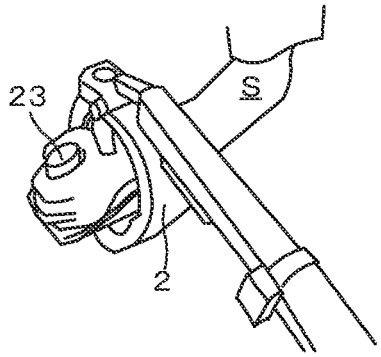
FIG. 24I is still yet another view illustrating measurement of the time for mounting the forearm in the case in which the hemiplegic forearm function recovery training device according to the present embodiment is used.

By contrast, as illustrated in FIGS. 24A to 24I, the mounting time required for mounting the forearm S in using the hemiplegic forearm function recovery training device 1 according to the present embodiment was measured. After start of the mounting (FIG. 24A; 00 min 00 sec), the gripping mechanism 23 was put in the hand from the bottom side (FIG. 24B; 00 min 01 sec), the gripping mechanism 23 was let gripped by the hand (FIG. 24C; 00 min 04 sec), and the wrist was held by the left and right forearm fixing portions 22 (FIG. 24D; 00 min 08 sec). Then the wrist was fixed and the mounting of the forearm S to the mounting body 20 was completed (FIG. 24E; 00 min 15 sec). Then the mounting body 20 was engaged with the forearm mounting part 2 (FIGS. 24F, 24G, and 24H; 00 min 18 sec to 00 min 19 sec to 00 min 21 sec). When the mounting body 20 was engagedly moved to the farthest position of the forearm mounting part 2, the mounting was completed (FIG. 24I; 00 min 24 sec). In the case of the hemiplegic forearm function recovery training device 1 according to the present embodiment, it only took 24 seconds in the mounting.

Figure 25A:
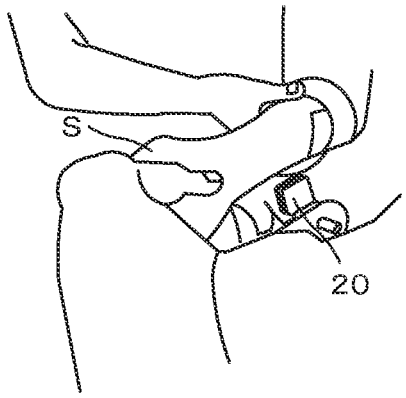
FIG. 25A is a view illustrating measurement a time for mounting a forearm of a serious case in a case in which the hemiplegic forearm function recovery training device according to the present embodiment is used.
Figure 25B:
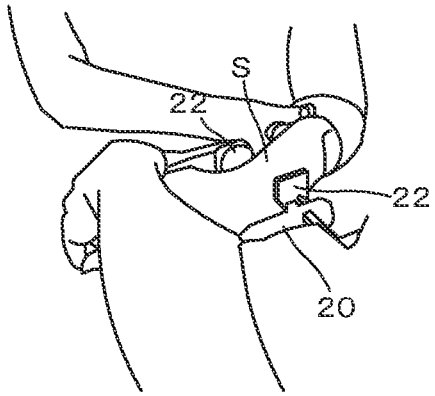
FIG. 25B is another view illustrating measurement the time for mounting the forearm of the serious case in the case in which the hemiplegic forearm function recovery training device according to the present embodiment is used.
Figure 25C:
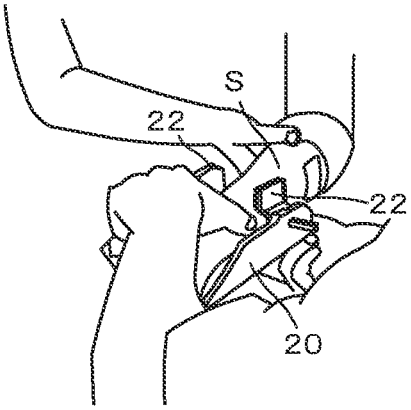
FIG. 25C is still another view illustrating measurement the time for mounting the forearm of the serious case in the case in which the hemiplegic forearm function recovery training device according to the present embodiment is used.
Figure 25D:
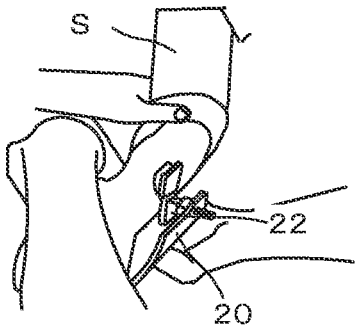
FIG. 25D is still yet another view illustrating measurement the time for mounting the forearm of the serious case in the case in which the hemiplegic forearm function recovery training device according to the present embodiment is used.
Figure 25E:
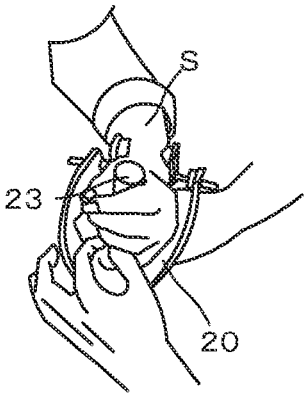
FIG. 25E is still yet another view illustrating measurement the time for mounting the forearm of the serious case in the case in which the hemiplegic forearm function recovery training device according to the present embodiment is used.
Figure 25F:
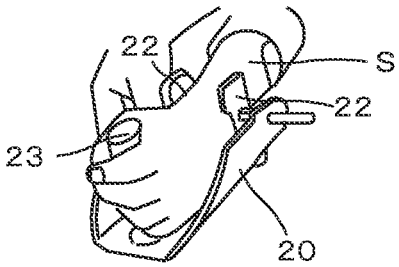
FIG. 25F is still yet another view illustrating measurement the time for mounting the forearm of the serious case in the case in which the hemiplegic forearm function recovery training device according to the present embodiment is used.
Figure 25G:
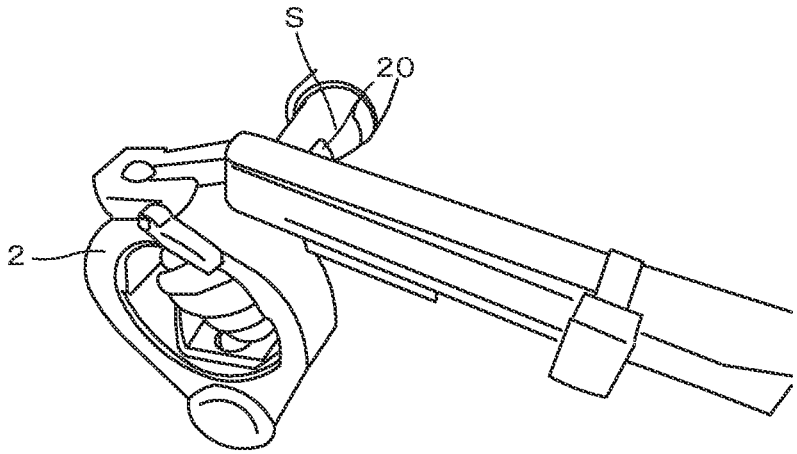
FIG. 25G is still yet another view illustrating measurement the time for mounting the forearm of the serious case in the case in which the hemiplegic forearm function recovery training device according to the present embodiment is used.
Figure 25H:
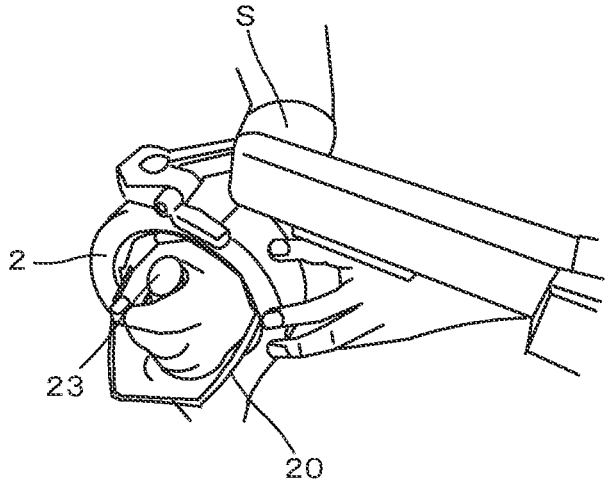
FIG. 25H is still yet another view illustrating measurement the time for mounting the forearm of the serious case in the case in which the hemiplegic forearm function recovery training device according to the present embodiment is used.
Figure 25I:
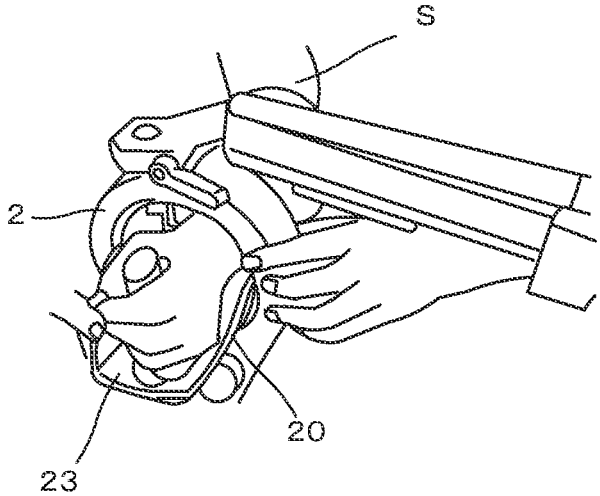
FIG. 25I is still yet another view illustrating measurement the time for mounting the forearm of the serious case in the case in which the hemiplegic forearm function recovery training device according to the present embodiment is used.

In addition, as illustrated in FIGS. 25A to 25I, the mounting time required for mounting the forearm of a serious case in using the hemiplegic forearm function recovery training device 1 according to the present embodiment was measured. First, the mounting body 20 was put in the forearm S from the bottom side while the fingers and wrist were being extended (FIG. 25A; 00 min 00 sec), and the forearm S was placed on the mounting body 20 (FIG. 25B; 00 min 03 sec). Then while the wrist was pressed to extend straight (FIG. 25C; 00 min 15 sec), the wrist was held by the forearm fixing portions 22 to fix the forearm S to the mounting body 20 (FIG. 25D; 00 in 39 sec). Then the fingers were laid on the gripping mechanism 23 one by one (FIG. 25E; 01 min 03 sec), and the mounting of the mounting body 20 was completed (FIG. 25F; 01 min 16 sec). In this state, the mounting body 20 was engaged with the forearm mounting part 2 (FIGS. 25G and 25H; 01 min 19 sec to 01 min 25 sec). The mounting was completed when the mounting body 20 reached the farthest position of the forearm mounting part 2 (FIG. 24I; 01 min 27 sec). In the case of the hemiplegic forearm function recovery training device 1 according to the present embodiment, it took 1 min 27 sec for the mounting time even for the serious case.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese patent Application No. 2017-167540, filed on Aug. 31, 2017, the entire disclosure of which is incorporated by reference herein.

INDUSTRIAL APPLICABILITY

The present disclosure can be applicable to promote recovery for a hemiplegic patient by training a paralyzed forearm of the patient.

REFERENCE SIGNS LIST

1 Hemiplegic forearm function recovery training device
2 Forearm mounting part
2A Outer frame portion
2Aa Housing
2Ab Rotation guide
2Ac Bearing
2B Inner frame portion
2Ba Groove
2Bb Pulley
2Bc Protrusion
2C Control part
2Ca Timing belt
2Cb Pulley
2Cc Rotation Drive
3 Arm part

3A Arm body
3B End cover
3C Spherical portion
3D Mount
3E, 3F Rotary portion
4 Mount
4A Housing
4B Lower plate
4C Pad portion
4D Fastener
4E Auxiliary fastener
5 Desk
20 Mounting body
21 Base portion
21Bc Protrusion
22 Forearm fixing portion
22A Pad portion
22B Ratchet mechanism
22Ba Slider
22Baa Hole
22Bab Mark
22Bb Case
22Bba Locking frame
22Bbb Protrusion
22Bbc Spring
22Bbd Unlock
23 Gripping mechanism
23A Grip portion
23B First adjustment mechanism
23C Second adjustment mechanism
23D Third adjustment mechanism
23E Rotation central axis
24, 25 Elbow mount
24A, 25A Pad portion
S Forearm

The invention claimed is:

1. A hemiplegic forearm function recovery training device for promoting recovery for a hemiplegic patient by training a paralyzed forearm of the patient, the device comprising:

a forearm mounting part on which the forearm is to be mounted, the forearm mounting part comprising:

a mounting body comprising a forearm fixing portion for fixing the forearm and a gripping mechanism capable of being gripped by a hand of the forearm fixed by the forearm fixing portion, an inner frame portion rotatable around the forearm together with the mounting body, and an outer frame portion to guide the inner frame portion in a rotation direction thereof.

2. The hemiplegic forearm function recovery training device according to claim 1, wherein the gripping mechanism comprises a grip that is a rod-like member extending in one direction to be capable of being gripped by the hand of the forearm, and a cross section of the grip that is orthogonal to a longitudinal direction of the grip has an elliptic or oval shape, and the gripping mechanism further comprises one of the following mechanisms:

a first adjustment mechanism to adjust a rotation position of the grip around an axis of rotation extending in the longitudinal direction, a second adjustment mechanism to adjust offset of the grip with respect to the central axis that is a center of rotation of the inner frame portion, and a third adjustment mechanism to adjust a position of the grip relating to a direction of the central axis that is the center of rotation of the inner frame portion.

3. The hemiplegic forearm function recovery training device according to claim 1, wherein the mounting body comprises:

a base portion to be fitted to the inner frame portion, a pair of pad portions to hold the forearm therebetween from opposite sides, and ratchet mechanisms attached to the base portion to enable the corresponding pad portions to be pushed against the forearm and enable the pushing against the forearm to be released with a one-touch manipulation.

4. The hemiplegic forearm function recovery training device according to claim 3, wherein the ratchet mechanisms each comprise a slider slidable with respect to the base portion and provided with the pad portion at a tip of the slider, and the slider is graduated.

5. The hemiplegic forearm function recovery training device according to claim 1, wherein the inner frame portion or the mounting body is provided with an elbow mount for placement of an elbow of the forearm.

6. The hemiplegic forearm function recovery training device according to claim 1, further comprising:

an arm part provided at a distal end with a first joint for coupling to the forearm fixing portion and at a proximal end with a second joint for coupling to a mount attached to a base, wherein the first joint and the second joint allow the position of the forearm fixing portion to be adjusted in 5 degrees of freedom.

7. The hemiplegic forearm function recovery training device according to claim 6, wherein the mount comprises a vice mechanism that enables attachment of the second joint to a plate-like member.

8. The hemiplegic forearm function recovery training device according to claim 1, wherein the forearm mounting part comprises a control part to perform a series of controls that repeatedly causes normal rotation, stop, reverse rotation, and stop of the inner frame portion while acquiring rotation angle information of the inner frame portion, wherein in the normal rotation the control part controls angular velocity or acceleration of the inner frame portion to stimulate a training target muscle of the forearm and in the reverse rotation the control part provides resistance to the inner frame portion to sustain stimulation to the training target muscle to maintain muscle tone.

9. A hemiplegic forearm function recovery training method for promoting recovery for a hemiplegic patient by training a paralyzed forearm of the patient, the method comprising:

mounting the forearm on a mounting body comprising a forearm fixing portion for fixing the forearm and a gripping mechanism capable of being gripped by a hand of the forearm fixed by the forearm fixing portion;

inserting the mounting body into an inner frame portion rotatable around the forearm; and performing a series of controls that repeatedly causes normal rotation, stop, reverse rotation, and stop of the inner frame portion while acquiring rotation angle information of the inner frame portion, wherein in the normal rotation the angular velocity or acceleration of the inner frame portion is controlled to stimulate a training target muscle of the forearm, and in the reverse rotation resistance is provided to the inner frame portion to sustain stimulation to the training target muscle to maintain muscle tone.

* * * * *